United States Patent [19]

Barber

[11] Patent Number: 4,920,890

[45] Date of Patent: May 1, 1990

[54] AMUSEMENT RIDE

[76] Inventor: Gerald L. Barber, 10 Whittington Ct., Greenville, S.C. 29615

[21] Appl. No.: 228,759

[22] Filed: Aug. 5, 1988

[51] Int. Cl.[5] ..... A63G 7/00; B60C 15/38

[52] U.S. Cl. ..... 104/53; 104/83; 104/292; 104/299; 191/22 C; 238/10 R

[58] Field of Search ..... 104/27, 28, 53, 139, 104/140, 288, 292, 295, 299, 301, 305, 83, 85; 191/22 C, 61, 63; 238/10 R, 121, 127

[56] References Cited

U.S. PATENT DOCUMENTS

| | | | |
|---|---|---|---|
| 1,422,764 | 7/1922 | Irsch | 104/53 |
| 2,685,003 | 7/1954 | Barnes et al. | 104/53 X |
| 2,687,225 | 8/1954 | Martin | 214/505 |
| 3,117,755 | 1/1964 | Kretzmer, Jr. | 191/22 C |
| 3,410,223 | 11/1968 | Miller | 104/139 |
| 3,537,401 | 11/1970 | Metzner | 104/299 |
| 3,720,437 | 3/1973 | Lambert | 296/1 A |
| 3,724,842 | 4/1973 | Wisdom | 272/29 |
| 4,017,932 | 4/1977 | Lotto et al. | 14/2.4 |
| 4,031,990 | 6/1977 | Matsui et al. | 191/63 |
| 4,628,560 | 12/1986 | Clevett et al. | 14/2.4 |
| 4,662,020 | 5/1987 | Wilkerson | 14/2.4 |
| 4,701,086 | 10/1987 | Thorndyke | 410/26 |

OTHER PUBLICATIONS

Datasheet (1 page) for Thomson Ball Bushings for Linear Motion, Thomson Industries Inc., Manhasset, New York, 11030.

Datasheet (1 page) Spherco Rod Ends by Morse.

*Primary Examiner*—Donald T. Majec
*Assistant Examiner*—Dean J. Kramer
*Attorney, Agent, or Firm*—Dority & Manning

[57] ABSTRACT

A portable amusement ride incorporates a multi-functional trailer which can serve for hauling the amusement ride, when disassembled, and serve as an elevated track portion of the ride, when assembled. Electrically powered vehicles are guided and powered over an electrified track having a main enclosed path, and an alternate loading area for discharge and pick up of passengers. Automatic launch and vehicle exit features between the main path and loading area prevent vehicle collisions, with minimum requisite operator activity. A pick-up assembly carried on the vehicle both guides and electrically powers the vehicle as it moves over the track. The track has an electrified pair of members also forming a guidance channel in which the pick-up assembly from the vehicle is received. The configuration of the pick-up assembly and its interaction with the electrified guidance channel causes proper electrical pick-up substantially regardless of the terrain formed by the track over which the vehicle travels. An alternate electrical pick-up embodiment uses resilient filler for quieter operation. Each vehicle includes a timing device to signal the ride operator riders have traveled for a given time, so that it may be routed into the loading area for exchange of passengers. A pneumatic lift system on each vehicle pivots the vehicle body upward for entry and exit of passengers.

20 Claims, 8 Drawing Sheets

AMUSEMENT RIDE

BACKGROUND OF THE INVENTION

The present application generally concerns various aspects of an amusement ride, and more particularly concerns aspects of a portable amusement ride having an electrified track incorporating a guidance channel for guiding and electrically powering a vehicle traveling thereover. Various aspects of the invention relate to both the track and the corresponding vehicle for use therewith.

In general, both in the area of amusement rides and in other fields, it has been known to provide arrangements wherein vehicles are intended to travel over a predetermined track. For example, in one amusement ride, gasoline engine powered go-carts may travel over a concrete track having an upright metal flange projecting therefrom, which flange is used to deflect and guide the vehicle as it is powered over the track by its gasoline engine. In some instances, a track slot is provided for guiding the vehicle. Since in either instance the vehicle is self-powered, there are generally no special problems or critical requirements for maintaining a close-tolerance predetermined relationship between the vehicle and the track as it travels thereover. The only interaction required is that adequate for deflection of the vehicle relative the track upright guide flange.

In another example of a known amusement ride, known as "bumper cars", an electrically powered vehicle receives electric drive power from an electrified track, but is steered by the passenger. In general, such rides have a totally electrified surface, which also requires a totally electrified ceiling to provide a complete electrical circuit with the vehicle. The vehicle is in contact respectively with the floor and ceiling through brushes carried on the underside of the vehicle and on an upwardly directed antenna or the like. Such layouts normally require that the floor and ceiling be as nearly uniform (i.e., planar) as possible. Even so, it is not uncommon for vehicles to become stuck in "dead spots", or unelectrified areas.

Accordingly, one of the particular disadvantages of electrically powered vehicles is the overall limitations imposed on an amusement ride utilizing such technology, due to the necessity of maintaining proper electrical contact between the vehicle and its track. Such consideration normally precludes the use of angled, bumpy, or hilly raceways, which would normally be highly attractive to potential passengers, especially younger children. Hills, banks, curves and the like are normally better accommodated by the above-mentioned exemplary concrete track layout, but typically such courses use gasoline powered engines, not electrically powered vehicles.

In addition to the limitation on track layouts whenever it is desired to use an electrically powered vehicle, the substantially critical nature of maintaining electrical contact between the vehicle and track means that even minor positional variations of an electrical pick-up assembly relative the electrified track can cause loss of electric power transfer. For example, if a vehicle track arrangement depends on the vehicle being level in order to properly present an electrical pick-up member to an electrified track for contact therewith, a slightly flat tire on such vehicle could completely disrupt electrical contact, since the vehicle would likely be at least slightly out of its level condition. With such an arrangement, even simple uneven loading of the vehicle, as can occur whenever the vehicle is occupied by disparate weight adult and child passengers, could cause loss of electrical contact, which obviously completely defeats operation of the vehicle.

As mentioned above, while electrically powered vehicles traveling over an electrified track is a generally known concept, actual guidance of such vehicles over the track is a completely additional aspect. Since such a vehicle depends on virtually continuous electrical contact for its propulsion, accomplishing certain manuevers such as track switching can be difficult. This is particularly the case if continuous propulsion is desired. Where miniaturized or toy slot cars are involved, handling of a vehicle can be little problem. But where passenger vehicles are involved, circumstances are entirely different. For example, in track changes with trolley cars or electric trains, it is common place to use rotating platforms or the like for re-directing the vehicles. Obviously, the vehicle must be halted for such procedures, and large forces are involved.

Other problems can persist. For example, the above-mentioned bumper cars are designed for relatively slow speed travel since (1) they are guided by the passengers themselves, and (2) are expected to collide with other vehicles. In many instances, however, it is more desireable to completely avoid collision between vehicles, especially where smaller children are concerned and/or it is desireable to achieve higher speeds.

Another disadvantage of the bumper cars ride mentioned above is that it requires a certain number of participants at any one given time in order to provide the desired level of passenger enjoyment. In other words, a certain number of vehicles must be operative at a given time in order to permit vehicle interaction, which is at least one of the important attractions of such a ride. Such a ride also necessitates that all passengers of all vehicles be let on and off during a common time period, since the entire track (i.e., vehicle travel area) is electrified while any of the vehicles are operative.

While some rides other than the bumper car type mentioned above provide for individual passenger operation (rather than collective operation of all vehicles in a common time frame), another problem occurs with such rides in that the operator must necessarily monitor the length of time each passenger is permitted to operate or ride on the vehicle. Moreover, the greater the number of vehicles, the more complex and difficult are the operation and monitoring problems of the operator. Higher volume of vehicles and passengers can cause or contribute to safety problems due to operator distraction, excess duties, or inadequate training time for handling typical operating conditions.

In addition to the foregoing specific disadvantages, it is also a common general situation at fairgrounds, circus camps, or the like, that space is at a premium. Thus, if a large trailer is needed for hauling a portable amusement ride, and such trailer has no usable purpose whenever it is not functioning as a trailer, then the trailer must be stored somewhere. Even if there is adequate space at the fairgrounds or the like, there can be considerable inconvenience if the trailer must be removed to a relatively remote location, i.e., off a midway area where the ride is erected.

In order to minimize such problems, it has been known in the prior art to incorporate a trailer into part of its corresponding amusement ride. For example U.S.

Pat. No. 3,724,842 issued to Wisdom utilizes the trailer as a rigid central support for a rotating amusement ride. Other portions of the trailer double as advertisement signs or the like.

In other known arrangements, trailers have been used to serve as mobile bridges. See for example U.S. Pat. No. 4,662,020 issued to Wilkerson, and U.S. Pat. No. 2,687,225 issued to Martin. It is also generally known to provide portable bridges, though not necessarily intended to serve as trailers while being carried from one location to another. See for example U.S. Pat. No. 4,628,560 to Clevett et al., and U.S. Pat. No. 4,017,932 issued to Lotto et al.

Other types of trailer arrangements have been provided with various added features to enhance their functionality. For example, U.S. Pat. No. 4,701,086 issued to Thorndyke, and U.S. Pat. No. 3,720,437 issued to Lambert, incorporate movable support decks or the like to facilitate handling of equipment and other material to be carried on the trailer.

SUMMARY OF THE INVENTION

The present invention recognizes and addresses the foregoing disadvantages and shortcomings, and others, of prior arrangements and constructions. Hence, it is a general object of the present invention to provide an improved amusement ride. It is a more particular object to provide an improved portable amusement ride, featuring an electrified track incorporating a guidance channel, for guiding and powering electrically powered vehicles thereover.

It is another object to provide an amusement ride which affords safe and convenient operation by an operator.

It is another general object to provide a track arrangement and corresponding vehicle adapted for use therewith, which permits variety in the terrain presented by the track, without loss of electrical power transfer between the track and vehicle. It is a more particular object to provide a vehicle with a pick-up head assembly adapted for following an electrified guidance channel of such track. It is yet another more particular object to provide such a pickup head assembly which also serves to guide the vehicle over the track, in addition to serving as an electrical contact with such track. Another object is the achievement of vehicle track switching, even at travel speeds, without loss of electrical power.

In addition to the foregoing general objects, it is also an object to provide a track arrangement and track control which facilitates safe entry of vehicles onto the main track from a loading track area, and likewise permits efficient exiting from such main track back to the track loading area. It is a more particular object to provide such automatic vehicle entry and exit from the main track area, with a minimum of operator expertise and attention, while yet safely effecting both such operations. It is another object to provide such automatic operations in a continuous loading operation, without requiring running of nonoccupied vehicles.

It is yet another object to provide a track arrangement and track control which fosters safe operation, and facilitates management of a plurality of vehicles traveling thereover, with minimum operator distraction. In conjunction with such track features, it is an object to provide a vehicle adapted for use with such track. It is another object to provide such a vehicle which also provides the operator with an indication whenever it is time to unload passengers from the particular vehicle, based on the length of time the vehicle has been operating on the main track.

In addition to providing such a vehicle with a self-timing feature, it is another object to provide vehicles with other improved features. For example, it is an object to provide a vehicle which utilizes a pneumatic lift arrangement for convenient entry of passengers into a passenger area, by pivoting movement of the vehicle body relative the vehicle chassis.

Another general object of the present invention is to provide a pick-up assembly which accommodates vertical, horizontal, and angular changes in the relation of the vehicle to an electrified track, without loss of electrical power transfer therebetween. It is a more particular object to provide rotatable electrical contacts for being carried on such a flexibly mounted pick-up assembly, which in turn may be mounted on a vehicle chassis for use in guiding and electrically powering such vehicle in relation to an electrified track.

Still another general object of the present invention is to provide an improved multi-functional trailer, which alternately serves for hauling an amusement ride (when disassembled) and serves as a bridged track portion thereof during use of the amusement ride.

These and other advantages, aspects, and features of the present invention will be better understood by those of ordinary skill in the art, upon review of the remaining disclosure. Such persons with skill in the art will also appreciate that various modifications and variations may be made to presently disclosed features, without departing from the spirit and scope of the present invention. Likewise, substitution of equivalents for such features may be practiced as desired. All such modifications and variations are intended to come within the scope of the present invention, by virtue of present reference thereto.

In addition to the foregoing, those of ordinary skill will appreciate that various embodiments of this invention may be provided by inclusion of different combinations of presently disclosed features in accordance with this invention. For example, one such exemplary embodiment in accordance with this invention is more particularly directed to a trackguided vehicle, adapted for use with a track of the type having a guidance channel formed therein with an upwardly facing slot therealong, such vehicle comprising: a chassis; wheels supported on the chassis for carrying same over the track; and vehicle guide means, extending between the chassis and the track guidance channel, for causing the vehicle to follow the track guidance channel as the vehicle travels over such track.

Such a vehicle guide means preferably may include a generally rigid, vertical shaft supported on the chassis and extending therebeneath towards the track guidance channel; a gimbal mount secured to the end of the generally rigid shaft extending beneath the chassis towards the track guidance channel; at least one track engagement member supported on the gimbal mount for multi-axis pivoting thereof relative the vertical shaft, and adapted to extend therefrom through the track guidance channel slot so that at least a portion thereof resides substantially within the guidance channel to be deflected thereby as the vehicle travels over the track, whereby the vehicle is also deflected through the interconnection of the generally rigid, vertical shaft with the chassis so as to follow the guidance channel.

Other embodiments of the present invention are more particularly directed to an apparatus for guiding and powering a vehicle by an electrified track, such track having an electrified guidance channel formed therein, such channel defining an upwardly-facing slot therealong.

One example of such an apparatus comprises: a main guide member, adapted to be mounted on a vehicle for traveling over such an electrified track, and having an end thereof extending generally downwardly from the underside of such vehicle towards the electrified track; multi-axis pivoting support means carried on the downwardly extending end of the main guide member; a pick-up head assembly mounted on the multi-axis pivoting support means for multi-axis pivoting movement relative the main guide member, such pick-up head assembly adapted for travel along the electrified track relatively adjacent the guidance channel thereof as the vehicle travels over such track; deflection guide force transference means, mounted on the pick-up head assembly and adapted to extend therefrom into the electrified track guidance channel through the upwardly facing slot thereof, for transferring deflection guide forces from the track guidance channel to the vehicle, for guiding such vehicle as it travels over such track by directing deflection forces upward to the vehicle through the pivoting support means and the main guide member; and electrical power transference means, mounted on the pick-up head assembly and adapted to extend therefrom into electrical contact with the track electrified guidance channel, for transferring electrical power from such electrified guidance channel to a vehicle as it travels over the track.

With such an apparatus, such mounting of the pick-up head assembly to the multi-axis pivoting support means enables the head assembly to cause the vehicle on which it is mounted to follow the track while maintaining electrical contact between the electrified guidance channel thereof and the electrical power transference means, regardless of the curvature of the terrain defined by the electrified track over which the vehicle is guided and travels.

Still other embodiments of the present invention are more particularly related to a pick-up assembly, adapted for guiding and powering an electrically-powered vehicle over a track having electrified guidance channel with an upwardly-facing slot.

One exemplary such pick-up assembly comprises: a generally vertically disposed connecting rod; a linear bearing received about an upper portion of the rod and supporting the rod vertically movable therein, such linear bearing adapted to be fixedly mounted on the underside of a vehicle to be guided; a multi-axis pivot received on the lower end of the rod, and providing multi-axis rotation at such lower end; a carriage member mounted on the multi-axis pivot for being pivotably supported on the rod lower end so as to be pivotably supported beneath the vehicle relatively adjacent the track guidance channel; a pair of respective guide wheels, rotatably supported on the carriage member and adapted for riding in the track guidance channel and transferring vehicle guiding forces upward from such channel to such vehicle through the connecting rod; and electrical contact means mounted on the carriage member, and adapted for contacting the track electrified guidance channel as a vehicle on which the pick-up assembly is mounted moves over such track, so as to provide electrical power to such vehicle.

With such a pick-up assembly, linear movement of the connecting rod relative the linear bearing, and pivoting movement of the carriage member relative the connecting rod enable the electrical contact means to maintain proper alignment and electrical contact with the track electrified guidance channel for powering the vehicle as such vehicle is guided over changing terrain defined by the track.

Other aspects and embodiments of the present invention more specifically concern amusement ride vehicles themselves, such as adapted to be powered from an electrified track having a guide member therealong for guiding the vehicle.

One such exemplary amusement ride vehicle in accordance with the present invention comprises: a main chassis; a plurality of wheels rotatably mounted on the chassis, for carrying same over the electrified track; electric drive motor means, mounted on the main chassis and drivingly connected with at least one of the wheels, for rotating such at least one wheel upon receiving electric power so as to propel the vehicle along the track; electric pick-up means, carried on the main chassis, and adapted for contacting the electrified track and conducting electric power therefrom to the electric drive motor means, whereby the vehicle may be propelled along the track; vehicle guidance means, carried on the main chassis, and adapted for contacting the electrified track guide member and guiding the vehicle in relation thereto for travel along the electrified track; and vehicle timer means, carried on the main chassis, for automatically outputting a signal indicating whenever the vehicle has been continuously propelled along the track for a predetermined period of time.

Another exemplary amusement ride vehicle in accordance with this invention includes: a main chassis; a plurality of wheels rotatably mounted on the chassis for conveying the chassis; drive means, mounted on the main chassis and drivingly connected with at least one of said wheels, for controllably rotating such at least one wheel for propelling the vehicle; vehicle guidance means, carried on the main chassis, for guiding the vehicle; a vehicle body pivotably supported on the main chassis, such body having an interior passenger area for vehicle passengers to ride therein supported on the main chassis, with access to such passenger area being gained by upward pivoting of the body relative the chassis; and pneumatic lift means, associated with the chassis and the body, for pivoting the chassis upward to permit passengers to enter and leave the passenger area, whereby the body otherwise generally protectively encloses passengers within the passenger area thereof while the vehicle is moving.

Other aspects and embodiments of this invention concern features of a controlled track arrangement for an amusement ride featuring a plurality of guidable, electrically-powered vehicles.

In general, such track arrangement includes: a primary track having a circuitous guide path which may be controllably electrified over the entire pathway thereof so as to continuously guide and advance in a predetermined direction thereabout guidable, electric-powered vehicles, such primary track including an entrance point at which vehicles off the circuitous guide path may be routed thereonto, and an exit point at which vehicles on the circuitous guide path may be routed therefrom; and a secondary track having a one-way guide path interconnecting between the primary track exit point and the entrance point thereof, such secondary track path including a plurality of consecutive, separately electrifiable path segments to permit respective vehicles to be selectively and controllably advanced therealong for loading and unloading of passengers for such vehicles.

In addition to such general track arrangement, an embodiment of this invention may include automatic launch control means, responsive to the travel of vehicles on the primary track path, for automatically preventing vehicles situated on the secondary track path and entering the primary track path at the entrance point thereof from colliding with vehicles already on the primary track path.

Another embodiment of a controlled track arrangement in conjunction with such general track arrangements may include automatic exit control means, responsive to an exit command signal input thereto, for automatically routing from the primary track path to the secondary track path only the vehicle next approaching the exit point of the primary track path.

Still further aspects of this invention are relate to an electric contact for conducting electricity between a track having an electrified member therealong and an electrically-powered vehicle adapted for traveling over such track.

One exemplary such contact comprises: a central axle including a bearing having electrically-conductive inner and outer races with electrically-conductive roller bearings trapped therebetween, such bearing being adapted to be carried on the vehicle by an insulative mounting with the inner race fixed relative thereto and the outer race rotatable relative thereto; a fixed electric terminal associated with the relatively fixed inner race, and adapted to electrically interconnect with an electrically-powered motive means supported in the vehicle on which the bearing is carried; a first rotatable electric terminal associated with the relatively rotatable outer race; an electrically-conductive annular member, situated concentrically about the central axle, forming the outside diameter of the electric contact, and defining an annular space between the inside diameter thereof and the central axle outer race; a second rotatable electric terminal associated with the annular member; electrically-conductive wire means inter-connected between the first and second rotatable electric terminals for conducting electricity therebetween; and resilient filler material residing in and filling the annular space between the annular member inside diameter and the central axle outer race so that the annular member and such outer race are generally coupled for mutual rotation relative the central axle inner race.

With such an electrical contact arrangement, the annular member is rotatable over a track electrified member as a vehicle carrying the electric contact travels over such track, with electricity being conducted from such track to such vehicle through an electrically-conductive pathway formed by the annular member, the second rotatable terminal, the wire means, the first rotatable terminal, the outer race, the roller bearings, the inner race, and the fixed terminal, whereby electrical contact is provided between such vehicle and such track while the resilient filler material provides insulation against mechanical shock and noise.

Still other features of this invention are embodied in a multi-functional trailer for use with a portable amusement ride, particularly where such ride has assorted separable pieces of equipment normally assembled during use of the ride, and a plurality of vehicles for use therewith.

An exemplary such trailer comprises: an integral main body having respective upper and lower storage surfaces adapted for carrying the amusement ride equipment and vehicles thereon; wheels mounted on the trailer main body to facilitate movement thereof; vertically-movable platform means, supported on the main body at one end thereof, for being selectively movable between positions adjacent to and level with the main body lower storage surface and the main body upper storage surface, so as to position amusement ride equipment and vehicles received thereon for transfer between the platform means and a selected one of the storage surfaces, such platform means also being movable to an intermediate position adjacent an area between the upper and lower storage surfaces for forming a trailer tongue adapted to be attached to a tractor for pulling the trailer; and lift means for controllably moving the platform means among the various positions thereof relative the main body storage surfaces.

Such a multi-functional trailer may alternately serve as a trailer for hauling the amusement ride vehicles and assorted equipment loaded thereon, with the platform means in the trailer tongue-forming, intermediate position thereof; and serve as a track portion of the amusement ride during use thereof, with the platform means in a position adjacent to and level with said main body lower storage surface, whereby vehicles of the amusement ride may drive on the trailer as a bridge with vehicles going through the main body traveling on the lower storage surface thereof, and traveling on the platform means situated level with the lower storage surface.

The foregoing exemplary embodiments, as well as some exemplary possible variations and modifications thereto, are discussed in greater detail below.

BRIEF DESCRIPTION OF THE DRAWINGS

A full and enabling disclosure of the present invention, including the best mode thereof, is set forth below with reference to the accompanying drawings, in which.

Figure 1A:
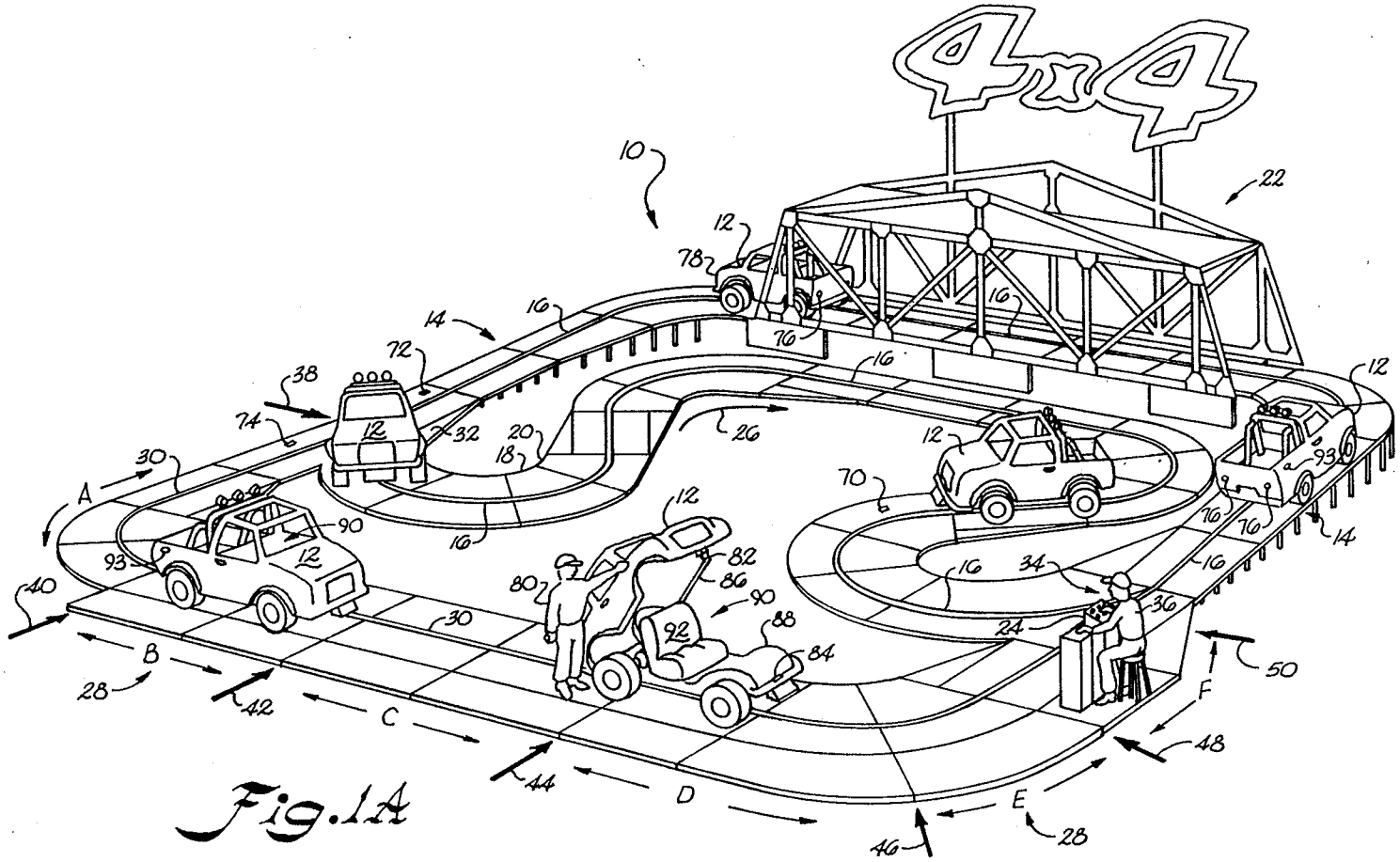
FIG. 1A is a perspective view of an assembled portable amusement ride in accordance with the present invention, incorporating track arrangement and control, a multi-functional trailer/bridge, and vehicles, in accordance with the present invention.

Repeat use of reference characters throughout the present figures and specification is intended to represent same or analogous features or elements of this invention.

DETAILED DESCRIPTION OF THE PREFERRED EMBODIMENTS

An amusement ride or similar structure is a relatively large-scale device. For example, the vehicles illustrated herein are fully half-scale of actual 4×4 trucks. As such, the invention incorporates numerous different features and aspects. Present FIG. 1A illustrates an exemplary lay-out of an amusement ride in accordance with the present invention. Virtually all aspects of the invention are represented by present FIG. 1A, but numerous additional details thereof are disclosed and discussed in conjunction with the remaining figures.

Moreover, while at least general representations of such features are made by present FIG. 1A, it is to be understood by those of ordinary skill in the art that such figure in fact is merely representative and exemplary of one embodiment of this invention, and is not limitive thereof. For example, the track illustrated in present FIG. 1 is not only shown as having a particular lay-out, but comprises a plurality of separable sections, so that the resulting amusement ride is portable. As an alternative, all of the present track and vehicle features may be incorporated into a permanent track lay-out such as used in amusement parks, instead of a portable lay-out as illustrated.

Furthermore, the actual shape or lay-out of the track (whether a permanent or temporary installation) is virtually immaterial, since the features of this invention may be utilized with virtually any track lay-out, of the users own choosing.

Present features of both the track arrangement and vehicle (particularly including the vehicle pick-up assembly) disclosed herewith permit track designs of almost infinite terrain variety. For example, hills, turns, angles, banks, and the like are fully accommodated by the particular pick-up assembly discussed below in greater detail with reference to FIGS. 2–6. The pick-up assembly as illustrated therein provides separate advantages in aspects of guiding and electrically powering vehicles, as well as advantages in simultaneously combining such functions, all as discussed below.

Construction, operation, and control of the exemplary track arrangement of present FIG. 1A is as follows. Controlled track arrangement 10 is an exemplary embodiment adapted for use with an amusement ride featuring a plurality of guidable, electrically-powered vehicles 12. Different body styles and shapes may obviously be adopted with particular amusement rides, but in this instance, both the vehicle bodies and ride theme are directed to 4×4 truck styles.

A primary track 14 includes a circuitous (i.e., fully enclosed circuit) guide path 16 which may be controllably electrified over the entire pathway thereof. The track itself in this embodiment is comprised of separable members, such as 18 and 20, which can be assembled and disassembled for forming the track layout. When disassembled, they may be loaded onto the convertible trailer/bridge 22, which will be discussed in greater detail below with reference to FIGS. 11–13.

Guide path 16 includes various features for conducting electric power to vehicles traveling thereover, and for providing guiding deflection forces to such vehicles, as is discussed in greater detail below with reference to FIGS. 2–5.

Preferably, guide path 16 is interconnected to a master control means or stand 24 for being selectively completely electrified so as to propel an electric-powered vehicle continuously about primary track 14. Essentially, master control means 24 comprises various power switches and the like, as described throughout the remainder of this specification. Specific details of relays, power switches, and the like are not disclosed herewith, since they are generally well-known to those of ordinary skill in the art, and such details do not themselves form aspects of the present invention. Instead, the overall configuration and function of the controlled track arrangement and other features form specific aspects of this invention, and are disclosed herewith in detail.

Once electrified, vehicles travel about guide path 16 receiving electricity therefrom and guided thereabout, as discussed below with reference to FIGS. 2–6. Travel is normally established in a predetermined direction, such as represented by arrow 26.

Controlled track arrangement 10 further includes a secondary track 28 which operates in conjunction with primary track 14 to provide a loading and unloading area for vehicles 12. Specifically, secondary track 28 has a one-way guide path 30 which provides guidance and electrical power to vehicles 12 generally utilizing a construction like that of guide path 16. One significant difference between primary track 14 and secondary track 28 is that guide path 30 is preferably segmented into a plurality of consecutive, separately electrifiable path segments. Such segmentation, and separate electrical control thereof, permits respective vehicles 12 to be selectively and controllably advanced therealong, which permits loading and unloading of passengers on a secondary track while other vehicles continue uninterrupted travel about the primary track. In general, the concept of advancing or "jogging" a vehicle along successive portions of a track is known to those of ordinary skill in the art.

Secondary track 28 preferably establishes a one-way path from an exit point 32 of primary track 14, to an entrance point 34 of such primary track. The exit and entrance points have respective gate means for controlling the actual travel of vehicles on the guide paths. Various controllable track gates are generally well-known to those of ordinary skill in the art, and are therefore not discussed herein in detail. However, it is preferred to use gate means generally of the type having two separate, controllably established positions. In one position thereof, a vehicle traveling on the primary track is permitted to continue thereabout, while in the other position a known deflection element or the like is positioned so as to permit vehicles to either enter or leave the primary track for travel on or from the secondary track, all of which is known and understood by those of ordinary skill in the art.

It is further preferred for safety reasons that a spring-biased gate means be used, with such spring biasing the gate means into a preferred position, such as one preventing exit or entry relative the primary track. With such a preferred arrangement, vehicles will safely continue travel about the primary track, with no vehicle exiting or entering relative the secondary track. Thus, only in a controlled operation, initiated by an operator 36, will vehicles exit or enter primary track 14. Operation of exit and entry features of this invention are discussed in greater detail below with reference to FIG. 1B.

For ease of illustration, the numerous electrical contacts between adjacent track segments and the like are not illustrated in FIG. 1A. Major layout segments having separate electrical control are however represented by arrows 38, 40, 42, 44, 46, 48 and 50. As mentioned above, guide path 16 of primary track 14 preferably comprises one electrifiable segment, which may be fully electrified or fully deelectrified with a single control, whereby all vehicles on primary track 14 are either propelled in common or not propelled.

In contrast, as mentioned above, secondary track 28 is preferably segmented into separately electrifiable portions so as to permit respective vehicles to be controllably advanced therealong. While various constructions of such segments may be practiced, the layout of FIG. 1A illustrates one preferred layout accommodating safe, efficient operation by an operator 36, as also discussed below in conjunction with FIG. 1B. In this instance, separately electrifiable segments are represented as existing between adjacent arrows 38–50 spaced at predetermined intervals along secondary track guide path 30. For example, a first segment A is defined essentially between electrical power interconnections adjacent arrows 38 and 40. A second segment B resides effectively between arrows 40 and 42, while controllable segments C, D, and E correspondingly fall between successive arrows 42, 44, 46, and 48. A defined launch segment F exists between arrows 48 and 50, and is controllably electrified in conjunction with operation of an automatic launch control means, as discussed below.

As generally represented by present FIG. 1A, controlled track arrangement 10 includes straight and curved portions, flat and elevated portions. Vehicles 12 and their associated pick-up assemblies effectively travel all such terrain, and generally any other terrain which might be defined with a particular track layout. Furthermore, a bridge portion of such track layout may optionally be incorporated through use of the convertible trailer/bridge 22, as illustrated.

Figure 1B:
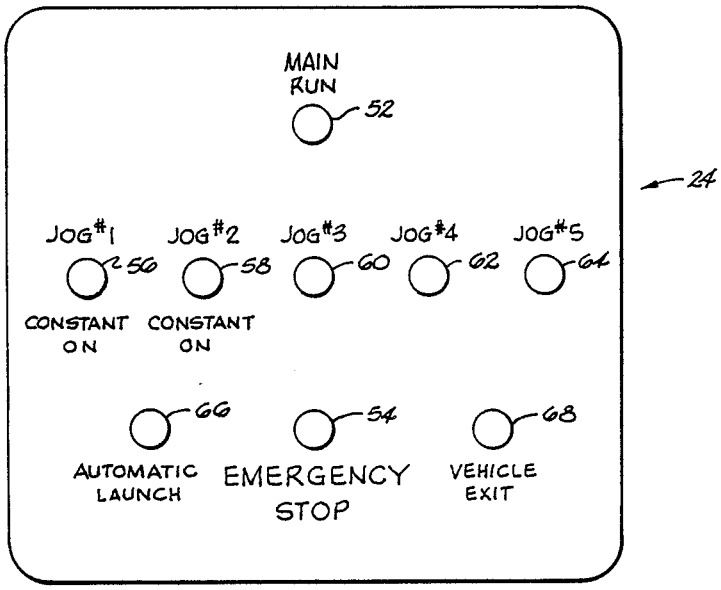
FIG. 1B is a control panel layout related to track control features as incorporated into the track arrangement of present FIG. 1A.

Referring now to FIG. 1B, additional details of master control means 24 are discussed. FIG. 1B represents an exemplary control stand panel layout. In other words, all controls needed for operator 36 to control track arrangement 10 are represented by the illustration of FIG. 1B. At such stand, the operator has control over all five secondary or loading track segments, vehicle primary track exit, automatic vehicle launch, and track main run and emergency stop features.

More in particular, the master control or track path electrification control means 24 includes main run control means 52 for controllably electrifying the entire pathway of primary track guide path 16, as discussed above. Emergency stop control means 54 overrides main run control means 52, and interrupts electrification of primary track guide path 16. Emergency stop control means 54 also simultaneously interrupts any electrification of segments A–F of secondary track 28. Respectively controllable means 56, 58, 60, 62, and 64 are provided for intermittently electrifying the secondary track path segment A–E, respectively. Controlled operation of such controllable means, also designated as "JOG" numbers 1–5, permits selected advancement of vehicles 12 along secondary track path 30, as understood by those of ordinary skill in the art.

Control means 52 and 54 preferably are provided by mutually exclusive in/out switches, which as understood by those of ordinary skill in the art will interconnect and disconnect electrical power from the respective track segments controlled thereby, as discussed above. Switches 56–64 preferably comprise intermittent switches, such as spring loaded toggle switches which may be pulled by operator 36 each time he or she wishes to intermittently electrify a corresponding secondary track segment A–E. Since JOG switches number 1 and 2 (control means 56 and 58) represent electrification of secondary path segments A and B, they may optionally be provided with a "constant on" function so that vehicles initially entering secondary track 28 from exit point 32 of primary track 14 may automatically be cleared from such initial area, all the way to segment C for loading and unloading of passengers.

Automatic launch control means 66 and automatic exit control means 68 are also represented in FIG. 1B. Such features constitute more than simple direct electrical switching as is generally the case with means 52–64, and thus provide as stated "automatic" features, which facilitate operation of the controlled track arrangement 10, so as to lessen the degree of operator training or attention needed for safe operation of the ride.

In particular, automatic launch control means 66 operates in conjunction with controllable electrification of defined launch segment F of secondary track 28, entrance point gate means discussed above in conjunction with entrance point 34, sensor means 70, and timer delay energization means incorporated into electrification control means 24, all as discussed hereinafter.

Sensor means 70 may comprise an electromagnetic sensor, an optical sensor, pressure sensor, or any other type of conventional device for sensing passage of a vehicle 12 thereby. Sensor means 70 is situated adjacent primary track guide path 16, at a known distance upstream from entrance point 34 thereof. Sensor means 70 detects passage of a vehicle thereby on the primary track guide path 16, and outputs a signal indicative of same to automatic launch control means 66. As discussed above, the gate means situated adjacent entrance point 34 (not shown) controllably permits or denies entrance of vehicles onto the primary track path at such entrance point, from the secondary track path launch segment F.

In operation, after initially starting the ride an operator 36 pushes a button at automatic launch control means 66 (FIG. 1B) whenever it is desired to begin launching vehicles 12 which enter the normally non-electrified launch segment F of secondary track 28. Previous to such point in time, operator 36 would have advanced such vehicle 12 along secondary track 28, and if desired loaded passengers on the vehicle. Electrification of the final segment E (operation of JOG switch number 5; means 64 of FIG. 1B) would have advanced the given vehicle into the automatically controlled launch segment F. The above-mentioned timer delay energization means incorporated into master control means 24 is responsive to outputs from sensor means 70, and to actuation of the switch means at 66, to control electrification of launch segment F responsive to passage of a predetermined time delay after a vehicle 12 on primary track 14 is sensed as moving past sensor means 70.

Selection of the predetermined time delay relative the known upstream distance of sensor means 70 from primary track path entrance point 34, in conjunction with the established travel speed of vehicle 12 on the primary track guide path 16, ensures that such a vehicle 12 on track 14 will be advanced beyond entrance point 34, before segment F is electrified. A vehicle on segment F can not pull out until the predetermined time delay has elapsed. Thus, the automatic launch control means, which is responsive to the travel of vehicles on primary track 14, automatically prevents vehicles situated on the secondary track path and entering the primary track path at entrance point 34 thereof from colliding with vehicles already on the primary track path.

In other words, since the electric drive means associated with each vehicle 12 is known to cause travel of the vehicles at a particular speed, given a certain level of electrification of such motor means, such speed and the known track distance is correlated with a predetermined period of time needed for a vehicle 12 passing sensor means 70 to clear entrance point 34. Once control means switch 66 is pushed, the vehicle residing on launch segment F is automatically advanced onto primary track 14 after the predetermined period of time is elapsed.

Additionally, the above-mentioned entrance point gate means is controlled during such electrification of launch segment F so as to permit vehicles to enter primary track guide path 16. As mentioned, such entrance point gate means is otherwise normally controlled for denying entrance of vehicles to the primary track guide path, which serves as a further safety feature to prevent collision of vehicles entering the primary track. The foregoing automatic launch control means provides an effective safety feature, with minimum operator activity.

Since in some instances the time delay means will be electrically operative separate from the primary track electrification, certain automatic launch operation must be followed. For example, if the timer is separately powered, it will continue to run after receiving an input from sensor means 70, even if track 14 is deenergized (such as with emergency stop button 54). Thus, a collision could occur whenever main run is resumed because launch segment F might become energized before the sensor means-triggering vehicle on track 14 has cleared entrance point 34. Re-pushing button 66 after any de-electrification of track 14 ensures that the timer is cleared, i.e., reset, so as to always register a proper time count relative true vehicle activity on track 14.

Controlled track arrangement 10 may also be provided with an automatic exit control means 68, which is responsive to an exit command signal input thereto (i.e., actuation of control means switch 68 of FIG. 1B), for automatically routing from primary track guide path 16 to secondary guide path 30 only the next vehicle 12 approaching exit point 32.

As mentioned above, a gate means (not shown) is also provided at exit point 32, and may be controllably positioned between a first position for permitting vehicles on primary track path 16 to continue thereabout, and a second position for diverting vehicles from the primary track path at exit point 32 thereof onto the secondary track path. Preferably, such gate means is biased for normally occupying its first position i.e., retaining vehicles on the primary track path.

The automatic exit control means in accordance with this invention controls operation of such exit point gate means, and in addition to receiving information from actuation control means switch 68, also receives information from first and second exit sensor means 72 and 74, respectively. Sensor means 72 and 74, like sensor means 70, may assume virtually any type of known sensor which will detect passage of a vehicle 12 thereby. First exit sensor means 72 is located adjacent the primary track guide path 16 relatively just upstream from exit point 32 thereof. Second exit sensor means 74 is located adjacent the secondary track guide path 30, and is situated relatively just downstream from the primary track exit point 32.

Since, as mentioned above, the exit point gate means is biased for normally causing vehicles to continue about primary track 14, until an operator 36 actuates vehicle exit means switch 68, any inputs from sensor means 72 and 74 are disregarded by the automatic exit control means. However, once an exit command signal is input to automatic exit control means, (i.e. vehicle exit switch 68 is actuated), passage of a vehicle 12 over first exit sensor means 72 causes the automatic exit control means to in turn cause the exit point gate means to assume its second position. Thus, the vehicle 12 which was just responsible for triggering an output from first exit sensor means 72 is diverted from primary track 14 onto secondary track 28. That same vehicle very quickly travels the short distance to the relatively adjacent downstream second exit sensor means 74, which second exit sensor means in turn outputs a signal to the automatic exit control means, which responds thereto by reverse actuating the exit point gate means to again assume its first position (for causing all subsequently approaching vehicles to remain on primary track 14). Receipt of an output signal from the second exit sensor means in such sequence also resets the first sensor exit means to prevent its actuation by passage of a vehicle until reactuation of switch 68 (i.e., reiteration of the exit command signal).

Thus, with minimum effort by an operator 36, a vehicle next approaching the exit point is automatically removed from the primary track to the secondary track for unloading of its passengers. Moreover, only such next approaching vehicle is removed, and thereafter the exit point gate means is automatically reset to cause subsequent approaching vehicles to continue about the primary track, unless vehicle exit switch 68 has again been actuated.

An operator 36 is preferably alerted to passage of a predetermined time to remove a respective vehicle from primary track 14, such as by illumination of light means 76 thereon. Each respective vehicle is preferably provided with its own vehicle timer means, as discussed below in conjunction with FIG. 9, which signals to the operator that such respective vehicle has been propelled about primary track 14 continuously for a predetermined, selected period of time. Once an operator 36, preferably in a favorable vantage-point such as illustrated in present FIG. 1A, observes illumination of light means 76 (such as provided in a rear or back-up light position on the vehicle), the operator may simply actuate switch 68 on the control panel represented by present FIG. 1B as the corresponding vehicle approaches generally the position shown for vehicle 78.

In other words, knowing the predetermined direction of travel 26 about primary track 14, an operator can observe that vehicle 78 is the next approaching vehicle to exit point 32. Thus, with such knowledge and upon becoming aware of the elapsed time signal (of whatever form), simple one-time pressing of vehicle exit switch 68 causes functioning of the automatic exit control means as discussed above to remove only such approaching vehicle 78. Thus, after actuating switch 68, operator 36 may maintain his or her attention to other aspects of operating controlled track arrangement 10, which tends to maximize safe operation of the amusement ride.

Once a vehicle 12 has been brought into secondary track 28 for loading and unloading, a helper 80 may release a latch means 82 and 84 to permit body 86 to be automatically pivoted upward from chassis 88 so that passengers may disembark from a passenger area 90 having seats 92 on such chassis. A precharge valve means 93, as discussed below in connection with FIG. 10, permits utilization of a pneumatic circuit also discussed in connection with such figure, which automatically lifts body 86 after operation of the simple latch means mentioned above. In general, such latch means may assume various forms for simply holding down body 86, against any upward biasing thereof by the above-mentioned pneumatic circuit.

Figure 2:
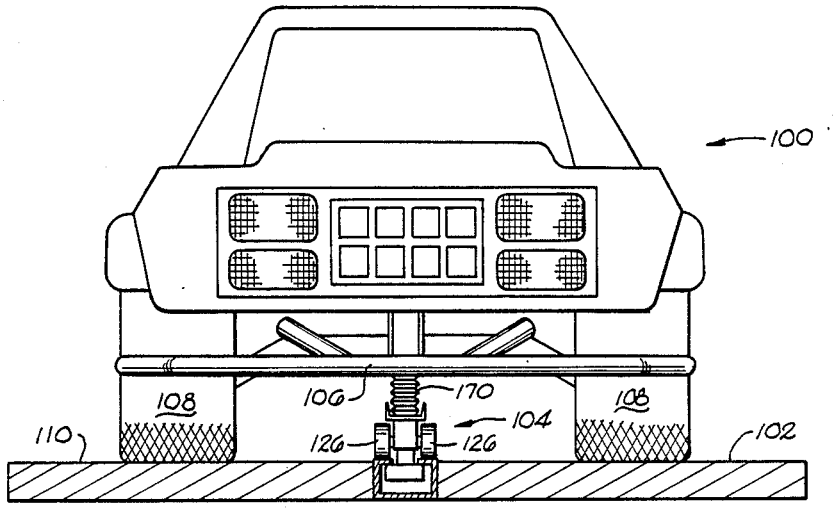
FIG. 2 is a front end elevation of a vehicle in accordance with the present invention, incorporating therein a pick-up head assembly in accordance with this invention for guiding and electrically-powering the vehicle over a particular track as provided by this invention, which track is shown in cross-section and in relation to the pick-up head assembly.
Figure 3:
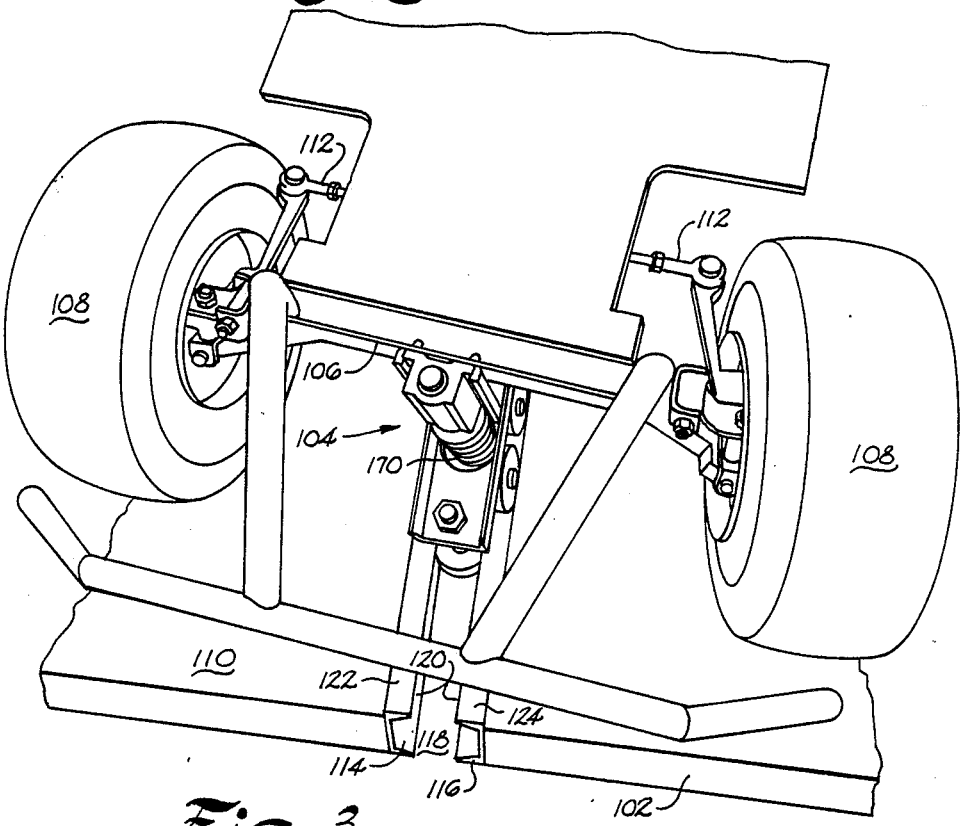
FIG. 3 is a perspective view of a vehicle chassis and pick-up head assembly mounted thereon, in accordance with the present invention, together with a partial sectional view of a track generally constructed as in FIG. 2.

As discussed in the Background portion of this specification, the present invention equally concerns aspects of the track configuration and control, as well as the provision of vehicles for traveling over such track. While this invention concerns such an improved track-guided vehicle, it further concerns a vehicle guide means, extending between the vehicle and its track, for causing the vehicle to follow the track as it moves thereover. More particularly, the vehicle guide means is mounted on a vehicle chassis to cause such chassis to follow a guidance channel in a track. Present FIGS. 2 and 3 illustrate such preferred relationship and cooperation between a vehicle 100, a track 102, and vehicle guide means generally 104. Vehicle 100 is shown as a front elevational view of vehicles substantially as those illustrated in FIG. 1A. Similarly, track 102 is a sectional view of a track portion such as in main track 14 or secondary track 28 of such FIG. 1A. Vehicle guide means 104 is one of the details represented generally in FIG. 1A, but better understood in the more detailed views thereof afforded by present FIGS. 2–6.

Referring to such figures, FIGS. 2 and 3 particularly illustrate that vehicle 100 comprises a main chassis 106 with a plurality of wheels 108 supported thereon for carrying the vehicle over an upper surface 110 of track 102. Various configurations of wheels may be utilized, but a four wheel arrangement comprises one of the preferred embodiments. Respective pairs of front and rear wheels are provided, with such pair of front wheels 108 being illustrated in FIGS. 2 and 3. In addition to being rotatably mounted relative chassis 106, the rotation axes of such front wheels 108 are pivotably mounted relative to chassis 106 so as to turn like a caster mount, with the vehicle being guided by vehicle guide means 104. Preferably, the pair of rear wheels (not shown in FIGS. 2 and 3) are driving the vehicle, and also rotatably mounted relative thereto, though not pivotably mounted. An interconnecting tie bar 112 ensures that thoroughly pivotable wheels 108 mutually respond (i.e., pivot) while following the vehicle over track 102. Wheels 108 are otherwise of conventional construction, such as rubber or the like, so as to frictionally engage and follow the upper surface 110 of track 102.

FIG. 3 illustrates a top perspective view of chassis 106 and vehicle guide means 104, with body 100 removed (at least, pivoted upwardly out of view) so as to more clearly illustrate the relationship and interaction of vehicle guide means 104 with track 102. As illustrated in connection with FIG. 1A, track 102 (like track members 18 and 20 of such figure) preferably comprises one of a plurality of separate track members which may be assembled and disassembled to provide a portable amusement ride. The track member itself primarily may comprise lightweight RIM molded urethane, fiberglass, or the like, as desired. Stainless steel or aluminum bracing members, not shown, may be used on the underside of the track members for providing adequate strength, and for holding together portions thereof otherwise separated by the pair of guide members 114 and 116 forming a guide channel 118 therein. Such guide members preferably comprise U-shaped members with their respective open ends facing one another so as to define the guide channel 118 therebetween, with an upwardly facing slot 120 therebetween. At least a portion of vehicle guide means 104 projects downwardly through such slot 120, as illustrated in FIG. 2, and engages the guide channel therein so as to transmit deflection guide forces upward from such guide channel to chassis 106, whereby the vehicle 100 is caused to follow track 102 as it moves thereover.

Guide members 114 and 116 preferably comprise some sort of metallic material, such as aluminum, so as to provide paired rails 122 and 124 defined in upper surface 110 of track 102. Of course, alternate electrified rails or the like may be provided in other electrified track installations, including portable and permanent installations. In portable rides, adjacent track members are preferably joined by conductive elements (metal bolts or the like) at their electrified rails, so as to simultaneously join such track members and complete the electric circuit thereabout. In a permanent installation, such guide members, guide channel, and electrified rails might be defined in a continuous concrete surface or the like. Electrified rails 122 and 124 are preferably slightly raised relative surface 110, as represented in FIGS. 2 and 3. Where an electrified track is provided and utilized, electric pick-up means 126 may also be carried on vehicle guide means 104 as discussed hereinafter.

Figure 4:
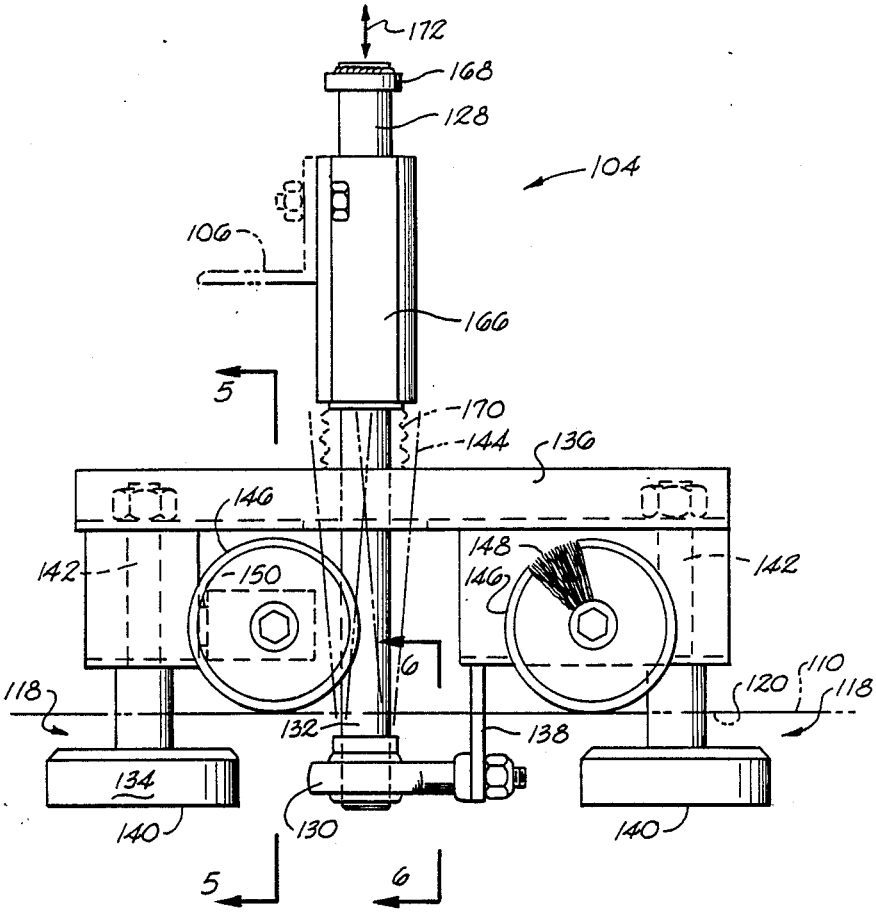
FIG. 4 is a partial, side sectional view of a pick-up head assembly as represented in present FIGS. 2 and 3.
Figure 5:
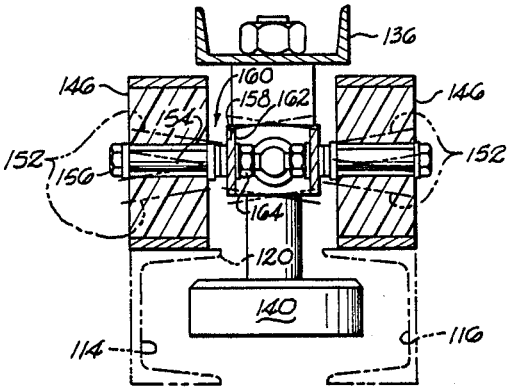
FIGS. 5 and 6 are partial sectional views of the pick-up head assembly of present FIG. 4, taken along the respective sectional lines 5—5 and 6—6 indicated therein.
Figure 6:
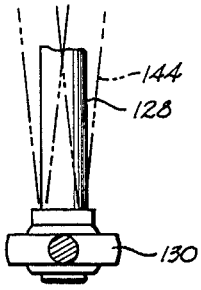

For the sake of clarity, though some details of vehicle guide means 104 and electric pick-up means 126 are represented in FIGS. 2 and 3, such details are instead primarily discussed in conjunction with FIGS. 4–6, which provide enlarged illustrations thereof.

FIG. 4 illustrates a side, partial seethrough view of vehicle guide means 104, including electrical pick-up means 126 mounted thereon. In general, vehicle guide means 104 includes a generally rigid, vertical shaft 128 supported on chassis 106 and extending therebeneath towards the track guidance channel 118. A gimbal mount 130 is secured to the end 132 of the generally rigid shaft 128 extending beneath the chassis towards the track guidance channel. Such gimbal mount serves as a multi-axis pivoting support means on the lower end 132 of the vertical rod or shaft 128. While various structures may be utilized for such gimbal mount, a SPHERCO rod end commercially available from the Morse Company, comprises one preferred exemplary construction of same.

At least one track engagement member 134 is supported relative gimbal mount 130 for multi-axis pivoting relative vertical shaft 128. Track engagement member 134 extends through the track guidance channel slot 120 so that at least a portion thereof resides substantially within guidance channel 118 to be deflected thereby as the vehicle travels over the track. Deflection forces are transmitted from member 134, back towards the vehicle through gimbal mount 130 and vertical rod 128, so that the vehicle itself follows the track guidance channel through its connection to the vehicle guide means at chassis 106.

More particularly, it is preferred that the guide head assembly 136 be supported directly on gimbal mount 130 through a connection arm 138. With such an exemplary guide head assembly, it is further preferred that track engagement member 134 actually comprise a pair of rotatable members 140 supported on guide head assembly 136 so as to extend through slot 120 substantially perpendicularly to upper surface 110 of track 102. Moreover, since members 140 are rotatable (preferably about bearings, not shown), and since the plane of rotation thereof is parallel with upper surface 110 of track 102, such members rotate as they engage side-to-side with guide channel 118, for absorbing deflections from the track guidance channel with minimal friction engagement therewith due to their relative rotation thereto whenever contacting the guidance channel.

FIG. 5 illustrates a sectional view of the construction of FIG. 4, as illustrated by sectional line 5—5 therein. As illustrated by such sectional view of FIG. 5, rotatable member 140 engages the inner sidewalls of U-shaped members 114 and 116 so as to be deflected thereby. Roller 140 preferably comprises a relatively hard, but resilient polyurethane material or the like for further minimizing noise and mechanical shock by engagement thereof with the guide channel forming members. Such construction is also durable. Since the vehicle drive force comes from the rear wheels, deflection forces on rod 128 are not excessive. With a pair of respective forward and trailing rotatable members 140 mounted on bearings (not shown) from arms 142 secured to guide head assembly 136, such guide head assembly smoothly travels relative electrified track 102 as it causes corresponding deflection of the vehicle.

FIG. 6 illustrates a sectional view taken along the section line 6—6 illustrated in FIG. 4, particularly illustrating the gimbal mount 130 of the present invention. As represented in both FIGS. 4 and 6 by the alternate solid line and dotted line illustrations, relative pivoting occurs in a multi-axis fashion between the multi-axis pivoted support 130 and vertical shaft or rod 128. For clarity in illustrating such pivoting movement, especially in FIG. 4, the substantially vertical shaft 128 is shown as moving, with the remainder of the pick-up head assembly illustrated in solid line as fixed. However, in actual use, it may be conceptually considered also that vertical shaft 128 is substantially fixed relative to chassis 106, and it is the remaining pick-up head assembly which is pivoted relative the lower end 132 of such shaft. Such pivoting movement, as also represented by the dotted lines 144 of FIGS. 4 and 6, accommodates variety in terrain determined by a track 102.

Whenever electric pick-up means 126 are also carried on vehicle guide means 104, such electric pickup means are at all times properly positioned for adequate electrical contact with electrified rails 122 and 124. Since the multi-axis pivoting of the guidehead assembly causes the assembly to be manipulated relative the track guidance channel (which is also associated with the electrified rails), the electric contact means 126 are always properly positioned for contact with such electrified rails.

Similar to rotatable guide members 140, electrical contact pick-up members preferably comprise rotatable elements 146. Such elements are also rotatably mounted on guide head assembly 136. Since their axis of rotation is perpendicular to upper surface 110 of track 102, the outer diameter of each rotatable member 146 is properly positioned for contact with the exposed electrified rails 122 and 124.

As shown in the partial cut-away view of FIG. 4, it is preferred that such rotatable members include stainless steel brushes or the like 148 for electrically contacting the electrified rail. Additional details of the mounting of such rotatable electric contact means are discussed below with reference to FIG. 14, in which an alternate embodiment of such members 146 is also represented. While the rotatable electric contacts 146 are insulatively mounted relative guide head assembly 136, they also each include a fixed terminal 150 (only one shown) transferring electric power from the track electrified rails to electrical devices on vehicle 100, such as an electric drive motor means. Preferably, at least two such rotatable electric contacts are provided with lateral spacing therebetween, for correspondence and alignment with the pair of electrified track rails, so that a complete electric circuit may be formed therewith, either AC or DC type.

As discussed above, gimbal mount 130 provides multi-axis pivoting support of guide head assembly 136 relative vertical shaft 128. FIG. 4 particularly illustrates front-to-back such pivoting, while FIGS. 5 and 6 better represent in dotted line side-to-side pivoting thereof. Such side-to-side pivoting permits laterally spaced rollers to maintain proper contact with the electrified rails, as suggested by the dotted lines 152 of FIG. 5. FIG. 5 also represents the proper insulative mounting of such rotatable electric contacts, though not illustrating every detail thereof, which details are described hereinafter. For example, central axle 154 is interconnected with a bolt 156 to a member 158 through a plurality of members 160. Such members 160, beginning adjacent to rotatable member 146, comprise, a thrust washer, and an insulating washer, followed by an insulator bushing. On the inboard side 162, between body member 158 and lock nut 164 are provided consecutively (beginning adjacent body 158) an insulating washer, followed by a flat washer, a wire terminal, and another flat washer. Thus, a suitable insulative mounting is provided. Additional details thereof are discussed below in connection with FIG. 14.

While a multi-axis pivoting mount has been discussed, it is also preferred that vertical shaft 128 be supported on chassis 106 with a degree of vertical freedom of movement, afforded by linear bearing means 166. In fact, linear bearing means 166 are directly mounted to chassis 106, and receive vertical shaft 128 therein, with freedom of vertical movement thereof stopped only by vertical rod collar 168 and engagement with guide head assembly 136.

One example of commercially available linear bearing means which is suitable for use in the present invention comprises the Thomson Ball Bushings for linear motion provided by Thomson Industries, Inc., of Manhasset, New York, 11030. The lower exposed portion of vertical shaft 128 residing between guide head assembly 136 and linear bearing means 166 is preferably surrounded with a protective accordion-like sleeve 170 (see also FIGS. 2 and 3).

Though linear movement is not represented by any alternate dotted line illustrations (for clarity in the illustrations), double-headed arrow 172 of FIG. 4 illustrates the manner in which vertical shaft 128 is permitted to move. Such degree of freedom in vertical movement further contributes to the ability of structures and embodiments in accordance with the present invention to effectively guide and electrically power a guidable, electrically-powerable vehicle about an electrified track, having a guidance channel and other features as discussed herein. In other words, regardless of whether the vehicle suffers a flat tire, otherwise has an imbalance due to unequal loading (such as parent and child on opposite sides thereof), or whether the vehicle traverses hills, angles, banks, or the like, the vehicle itself is guided due to deflections transmitted thereto beginning with rotatable guide wheels 140, while electrical power is transmitted thereto beginning with rotatable electric contacts 148. Such electrical contacts are always properly positioned due to the type of accommodating mounting disclosed herewith.

Figure 7:
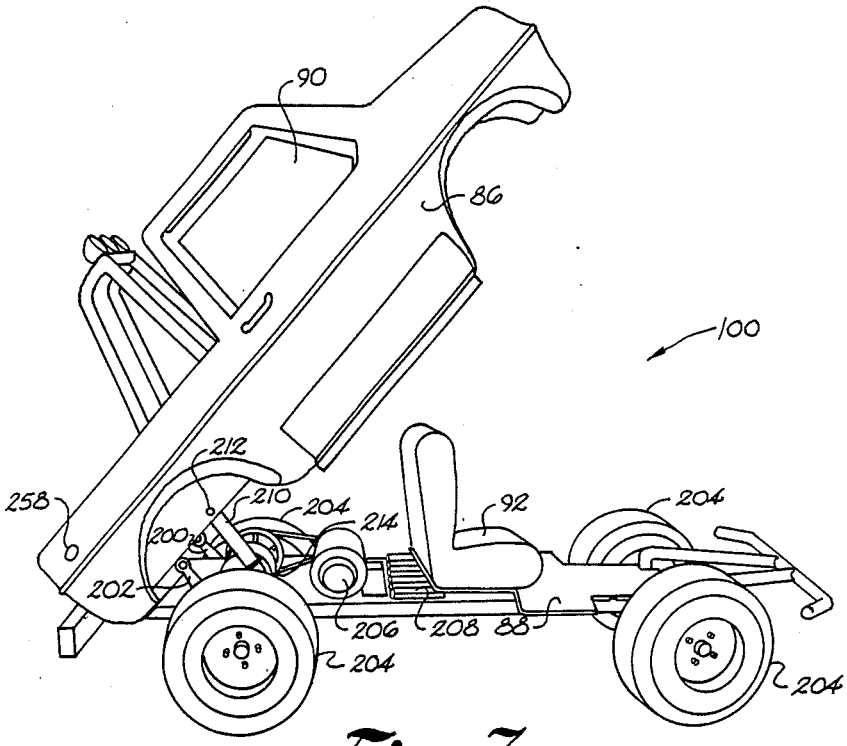
FIG. 7 is a perspective side view of a vehicle in accordance with the present invention, particularly illustrating the chassis thereof, with a vehicle body pivotably mounted thereon.

FIG. 7 illustrates a vehicle, such as vehicle 100 in FIG. 2, having a chassis 88 with a body 86 pivotally mounted thereto. A pair of pivot brackets 200 and 202 are mounted on chassis 88 relatively towards the rear thereof. A plurality of wheels 204 (preferably four in number) are rotatably mounted on the chassis for carrying same, preferably over an electrified track. An electric drive motor means 206 is also carried on chassis 88, as is a pick-up similar to that as illustrated in FIG. 4 (not shown in FIG. 7). Such a pick-up assembly incorporates both electric pick-up means and vehicle guidance means, as discussed above.

Various electrical circuit components 208 are also supported on the chassis, generally as discussed below in connection with FIG. 9. Also carried on the chassis, as discussed below in connection with FIG. 10, are pneumatic lift means, as represented by extendable air cylinder 210 of FIGS. 7 and 8. The air cylinder constitutes one exemplary embodiment of a pneumatic lift means associated with a chassis and body for pivoting the chassis upward to permit passengers to enter and leave passenger area 90, being seated on seats 92. Whenever body 86 is pivoted downward so as to be fully supported on chassis 88 (as illustrated such as with vehicle 78 of FIG. 1A and vehicle 100 of FIG. 2), the passengers are protectively enclosed within passenger area 90 while the vehicle is moving. Representation of latch means 82 and 84 illustrated in FIG. 1A are not repeated in present FIG. 7.

Figure 8:
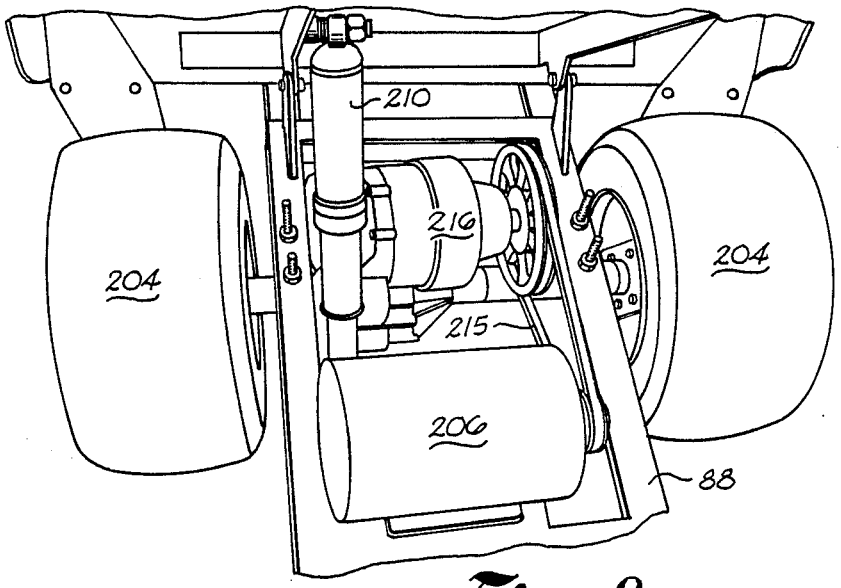
FIG. 8 is an enlarged, detailed view of the construction of FIG. 7, showing from a top perspective view the generally rearward chassis area where the vehicle body is pivoted thereto.

Extendable air cylinder 210 is pivotably mounted at respective ends thereof 212 and 214 to fixed points on the body and the vehicle chassis, such that extension of the air cylinder causes the vehicle body to be pivoted upwardly, as illustrated in FIG. 7. FIG. 8 is a perspective view of the rearward end of vehicle 100, including a view of electric motor means 206 and air cylinder 210. Electric motor means 206 preferably turns a drive belt 215 which powers a differential transmission drive 216, which in turn drives rear wheels 204. As illustrated by FIG. 8, there is ample room on the opposite side of chassis 88 from air cylinder 210 to provide another, parallel air cylinder should same be desired (and as is discussed in connection with FIG. 10 below).

Figure 9:
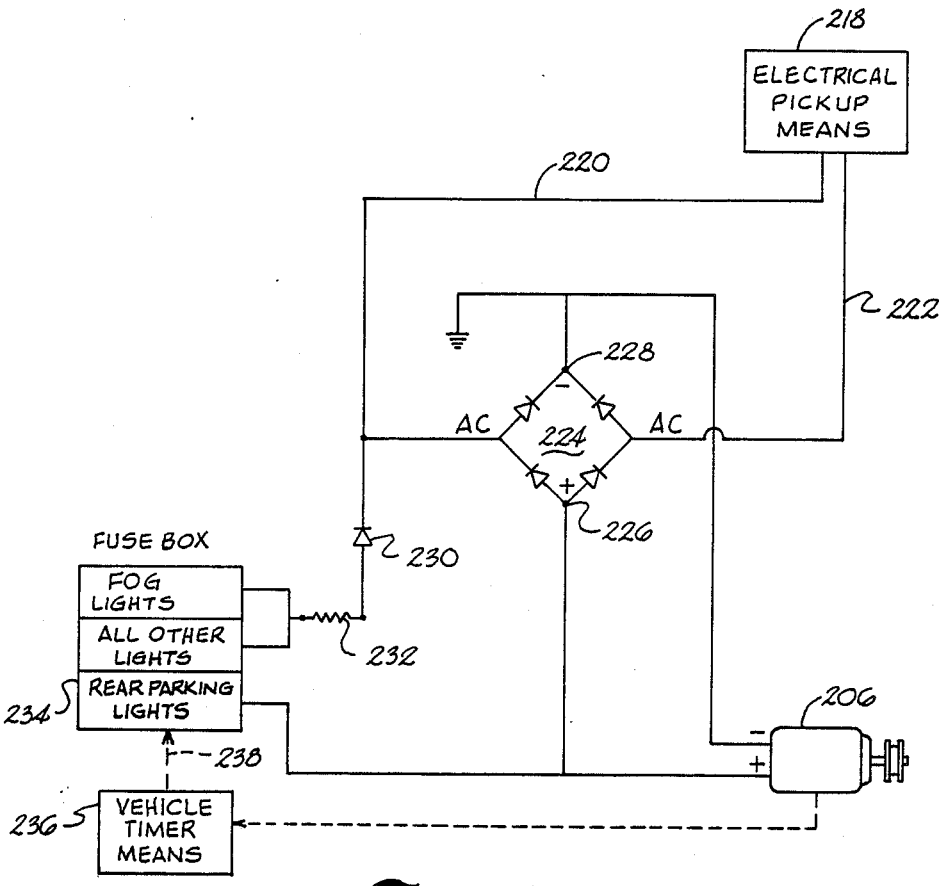
FIGS. 9 and 10 schematically illustrate other chassis-mounted features of the present invention, including electrical circuitry and pneumatic circuitry thereof, respectively.
Figure 10:
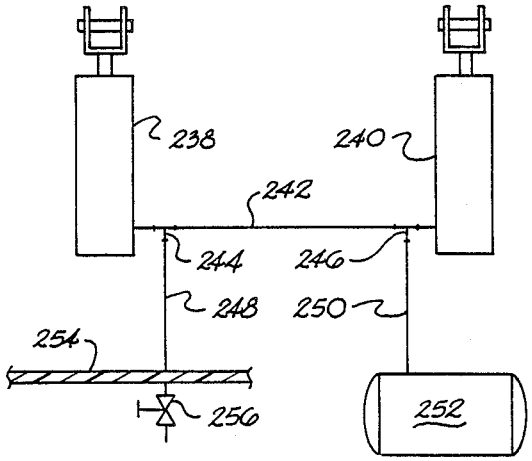

FIG. 9 illustrates schematic representation of exemplary electrical wiring received on chassis 88. Electrical pick-up means 218 thereof may comprise various structures, but preferably includes at least a pair of rotatable electric contacts such as 146 of present FIG. 5 (or the alternative embodiment of FIG. 14, discussed below), for outputting two separate outputs 220 and 222. With such two outputs from the electrical pick-up means, a completed electric circuit may be formed with electric motor means 206, and other electrical loads carried on the chassis.

While either AC or DC electrical power transmission may be utilized with the pair of electrified rails, it is preferred that 32 volts AC be carried on the rails, and consequently output along lines 220 and 222. A full wave bridge rectifier 224 of conventional construction receives the AC power and converts same to a reduced DC voltage level, in this instance 24 volts DC. The DC outputs 226 and 228 are then forwarded to electric drive motor 206 (a 24 volts DC motor) for powering same. Other types of motors may be substituted, with corresponding circuit charges as understood by those of ordinary skill in the art. As represented by the electrical circuitry of present FIG. 9, any electrical power received through electrical pick-up means 218 is preferably forwarded for energizing electric drive motor means 206, thus resulting in propulsion of the vehicle any time the corresponding track is electrified.

Various additional lights, horns, and the like may optionally be provided on the vehicle, and selectively operated on AC or DC circuits. For example, certain lights may be operated at yet a further reduced DC voltage level, such as 12 volts, through use of a dropping diode 230 and resistor or coil 232.

The rear parking lights 234 preferably correspond with the light means 76 illustrated in present FIG. 1A, and serve to signal an operator 36 that an elapsed period of continuous propulsion of a vehicle about the primary track has occurred. Other forms of signaling means may be practiced, including alternate sensory devices using audio and touch senses, located on vehicles or the control stand.

As discussed above, vehicle timer means 236 are provided preferably on each respective vehicle for permitting operation of light means 234 upon the passage of the predetermined period of continuous propulsion. Vehicle timer means 236 controls light means 234 through line 238, and may through various means receive information about propulsion of its corresponding vehicle. For example, the vehicle timer means may be provided so as to count time whenever electric motor means 206 is operative, either in a motor or generator mode, since such turning will occur only whenever the vehicle is being moved (assuming that motor means 206 is arranged for driving at least one of the vehicle wheels). In other words, if motor means 206 is being energized, the vehicle timer means will be counting time. If on the other hand there is a temporary outage of power, but inertia of the vehicle and/or motor means causes continued propulsion of the vehicle, operation of the motor means as a generator will still cause the vehicle timer means to continue its count. Only whenever the vehicle comes to a complete stop, such as its at rest condition in launch segment F prior to entering the primary track (see FIG. 1A and its related discussion), will the vehicle timer means be reset.

Thus, in essence, all of the loading and unloading operations which may occur along secondary track 28 (as discussed above) causes successive time count resets of the vehicle timer means. Only continuous operation along primary track 14, as intended during normal operation thereof, causes the vehicle timer means to run and eventually result in illumination of light means 234. Therefore, operator 36 is apprised of operation of each respective vehicle on the primary track for the predetermined period of time. Such predetermined period of time may obviously be varied in order to adjust the desired length of travel time for rides. Furthermore, other non-illustrated optional features, such as horns or the like, may be also powered and/or incorporated into the electrical circuitry illustrated on FIG. 9. Such may include relatively powerful lights to facilitate nighttime operation. Various heat sink means and the like may also be utilized, as well understood by those of ordinary skill in the art without indication of greater details herewith.

FIG. 10 illustrates an exemplary preferred pneumatic circuit which may be carried on chassis 88 of the vehicle. In particular, a pair of extendable air cylinders 238 and 240 are provided for mounting between the vehicle chassis and body, in the manner described above with reference to air cylinder 210. Such air cylinders preferably more comprise air "springs" than air shocks, though variety may be practiced. Tubing 242 openly interconnects the pair of air cylinders. T-connectors 244 and 246 also interconnect tubing 242 with tubing 248 and 250, respectively. Tubing 250 interconnects with a prechargeable pneumatic pressure reservoir tank 252, which may be provided with a precharge amount of pneumatic pressure for biasing air cylinders 238 and 240 so as to raise body 86 upwardly. Tubing 248 preferably penetrates a sidewall 254 of vehicle body 86, and terminates in a valve means 256 which may be of any suitable known construction which permits selected introduction and exit of pneumatic pressure from the pneumatic circuit illustrated on FIG. 10. Valve means 256 is thus preferably mounted for easy access on the vehicle body, as represented by member 258 of present FIG. 7, and member 92 of present FIG. 1A.

In operation, the initially provided pneumatic circuit is situated on its respective vehicle. Thereafter, the vehicle body (such as preferably lightweight fiberglass) is pivoted upward from its chassis, as represented by present FIG. 7. Using valve means 256, the pneumatic circuit is then charged up to a certain level, such as approximately 100 pounds of pressure, which normally slightly holds the body upwardly, but is not enough to prevent the body from being manually pivoted downwardly and held by latch means 82 and 84, as discussed above with reference to FIG. 1A. Since the above-described tubing permits free movement of pneumatic pressure between air cylinders 238, 240 and reservoir tank 252, closure of body 86 after pre-charging of the pneumatic circuit causes the pressure in reservoir tank 252 to increase, which provides the above-mentioned biasing effect. Alternative pneumatic means, as well as substitution of equivalents therefor, may be practiced.

Figure 11:
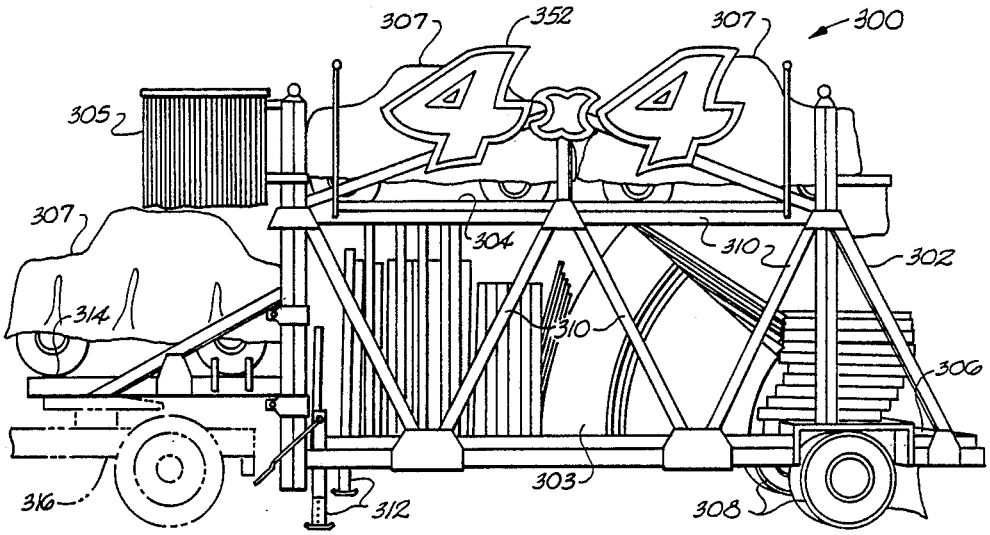
FIG. 11 is a side perspective view of a fully loaded multi-functional trailer in accordance with this invention, configured for travel with assorted disassembled pieces of the portable amusement ride stored thereon.
Figure 12:
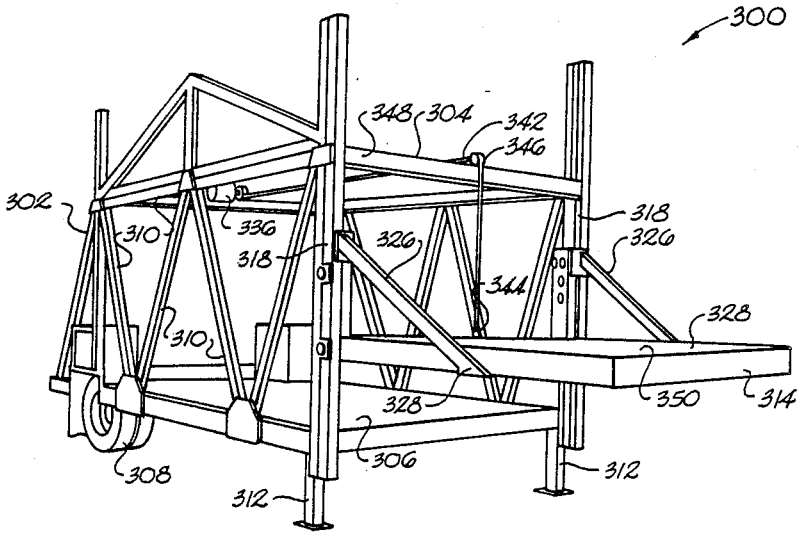
FIG. 12 is a generally reversed, perspective view of the trailer as illustrated in FIG. 11, with the disassembled amusement ride removed therefrom so as to show more clearly particular features of the trailer itself.
Figure 13:
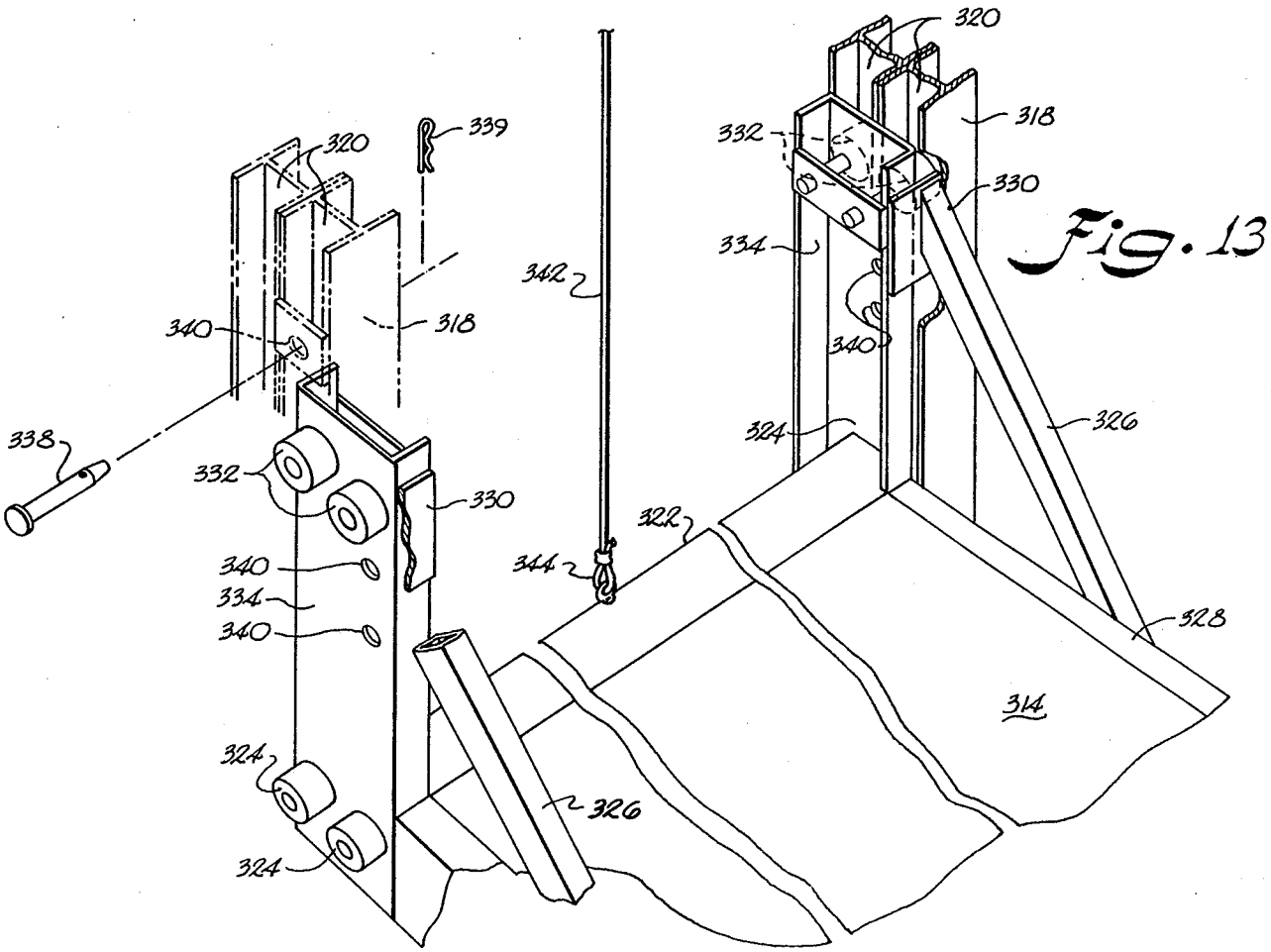
FIG. 13 is a partial, perspective and cutaway view of the trailer of FIG. 12, particularly illustrating aspects concerning a movable platform thereof.

Referring now to FIGS. 11–13, further details of a multi-functional trailer in conformance with the present invention are discussed. FIG. 1A illustrates a convertible trailer/bridge 22 which may be incorporated into primary track 14 as a bridge feature thereof during use of the corresponding amusement ride. However, whenever such amusement ride is disassembled, i.e., the track segments 18, 20 and the like are taken apart, all of the separable pieces of amusement ride equipment and the plurality of vehicles for use therewith may be loaded onto the trailer as represented in present FIG. 11.

FIG. 11 illustrates a fully loaded trailer 300, having thereon a plurality of separable track pieces 303, fence pieces 305, and vehicles 307. Since a side view is shown, only three vehicles are illustrated, but preferably there is adequate room for a double row of such vehicles, such that the six vehicles illustrated in present FIG. 1A may all be loaded and carried on trailer 300. Embodiments of larger (or smaller) capacity may be practiced in conformance with this invention. Hereafter, reference will also be made to FIGS. 12 and 13 collectively with reference to FIG. 11 for ease of discussion of same.

FIG. 12 illustrates a reverse, perspective view of only the trailer structure of FIG. 11, with all equipment thereon removed for greater clarity in illustrating various trailer features. FIG. 13 illustrates in partial see-through partial cut-away detail, a perspective view of a vertically-movable platform means and associated features of the trailer 300.

Trailer 300 includes an integral main body 302 having respective upper and lower storage surfaces 304 and 306. As particularly illustrated in FIG. 11, such storage surfaces are adapted for carrying the amusement ride equipment and vehicles thereon. Integral main body 302 also includes wheels 308 mounted thereon to facilitate movement of the trailer. The main body framework preferably includes a plurality of interconnected rigid members 310 (only some of which are marked for clarity in the illustrations), and further includes a pair of vertically-movable jack members 312 adjacent one end thereof to support the trailer whenever the trailer serves as a track portion of an amusement ride. Wheels 308 are preferably mounted on an opposite end of the main body from such jack members. As may be noted by comparing the trailer constructions of FIG. 1A and 11, variety may be practiced in the exact placement of rigid members 310 forming main body 302.

Trailer 300 also includes a vertically-movable platform means 314 supported on main body 302 at one end thereof. Such platform means may be selectively movable between positions adjacent to and level with main body lower storage surface 306 and main body upper storage surface 304. By being moved into one or the other of such positions, amusement ride equipment or vehicles received thereon may be transferred between the platform means and a selected one of the storage surfaces. Both FIGS. 11 and 12 illustrate platform means 314 situated in an intermediate position thereof adjacent an area between the upper and lower storage surfaces, for forming a trailer tongue (gooseneck type) adapted to be attached to a tractor for pulling the trailer. In particular, FIG. 11 schematically represents the rear portion of a tractor rig 316 as it would be preferably attached to the platform means 314 in its trailer tongue-defining configuration.

Referring more particularly to FIGS. 12 and 13, the trailer main body framework includes respective upright members 318 incorporated into the interconnected rigid members 310 thereof. Such respective upright members 318 are formed at the end of the main body 302 adjacent platform means 314. As best illustrated in FIG. 13, the upright members define substantially vertical channels 320 in which members of the platform means are supported and guided for vertical movement therein.

More particularly, the platform means comprises a generally planar, rectangular construction, with one side edge 322 thereof having guide rollers 324 at its respective corners. Such guide rollers are only visible in the Figures on one corner of side edge 322, but are generally indicated on the opposite corner thereof. Vertical channels 320 represented in dotted line in FIG. 13 illustrate together with FIG. 12 the relationship between such channels and guide rollers 324. Such relationship is that the guide rollers are received in the respective vertical channels of the upright members 318, for support and guidance of the platform means relative the main body.

A respective pair of angled brace members 326 are also preferably provided, and have respective ends connected to respective points 328 of the platform means removed from the one side edge 322 and respective corners thereof. Respective opposite ends 330 of such brace members also generally carry guide rollers 332 which are received in vertical channels 320. An additional upright interconnecting brace 334 may be used to add greater strength to the platform means construction. With the exemplary arrangement as illustrated, platform means 314 is supported in a cantilevered fashion from vertical channels 320, with all of the guide rollers 324 and 332 received in such channels for vertical movement therein.

In addition to the foregoing features of trailer 300, lift means 336 are provided for controllably moving platform means 314 among the various positions thereof relative the main body storage surfaces. Furthermore, locking means 338 are provided for selectively securing platform means 314 relative the main body 302 whenever the platform means occupies the intermediate position thereof illustrated in FIGS. 11 and 12, so as to form a functional trailer tongue with the platform means, as discussed above with reference to FIG. 11. Such locking means may comprise a cotter pin arrangement (including pin 339) of heavy metal gauge received through aligned openings 340 in the upright members 318 and various movable portions of platform means 314, all as represented in present FIG. 13.

Lift means 336 may comprise numerous mechanisms such as hydraulic, pneumatic, or electrically powered systems, but preferably comprises a selectively operative winch cable and pulley system incorporated into the main body for controllably raising in a vertical plane the platform means, and any vehicles or equipment received thereon. As illustrated in FIGS. 12 and 13, an electric-powered winch includes a cable 342 which is attached at 344 to a relatively central area of side edge 322 of platform means 314. A pulley 346 or any other arrangement may be practically used for entraining cable 342 throughout main body 302, all in conformance with the present invention.

It should be noted that upper storage surface 304 is not actually illustrated in place in present FIG. 12, for clarity in illustrating one possible positioning of the winch cable and pulley system comprising lift means 336. Various options may be practiced. For example, platform 304 may be provided in an area slightly above cable 342. Alternatively, cable 342 may be entrained in a pulley 346 mounted on the underside of cross-beam 348, rather than on the top thereof. Further alternatively, cross-beam 348 may be provided with a central opening, through which cable 342 is routed. All such variations are intended to come within the spirit and scope of the present invention.

Whenever platform means 314 is lowered into a position adjacent to and level with lower storage surface 306, the entire trailer 300 may be incorporated into a portion of the controlled track arrangement 10 of present FIG. 1A, such as the bridge portion 22 thereof. Moreover, vehicles may travel over the lower storage surface and the upper surface 350 of platform means 314 by literally driving through main body 302 of such multi-functional trailer. Obviously, various measures may be undertaken in order to facilitate use of trailer 300 as a bridge feature. For example, cable 342 must be disconnected at point 344 and removed to a safe area to permit passage end-to-end of vehicles through the trailer. Likewise, wheel chocks or the like may be used to immobilize trailer wheels 308 from movement.

Whenever the multi-functional trailer is utilized as a portion of the controlled track arrangement, track portions including guide members and electrical power distribution system (e.g., electrified rails), as discussed above in conjunction with the other illustrated track members such as 18 and 20 of FIG. 1A, may be incorporated into or applied over the top of surfaces 306 and 350. Numerous other variations may also be practiced to enhance aesthetic and functional aspects in conjunction with utilizing trailer 300 in the amusement ride controlled track arrangement. For example, the "4×4" sign 352 or similar substitute markings may be utilized to draw passengers or the like. All such modifications and variations are intended to come within the spirit and scope of the present invention.

Figure 14:
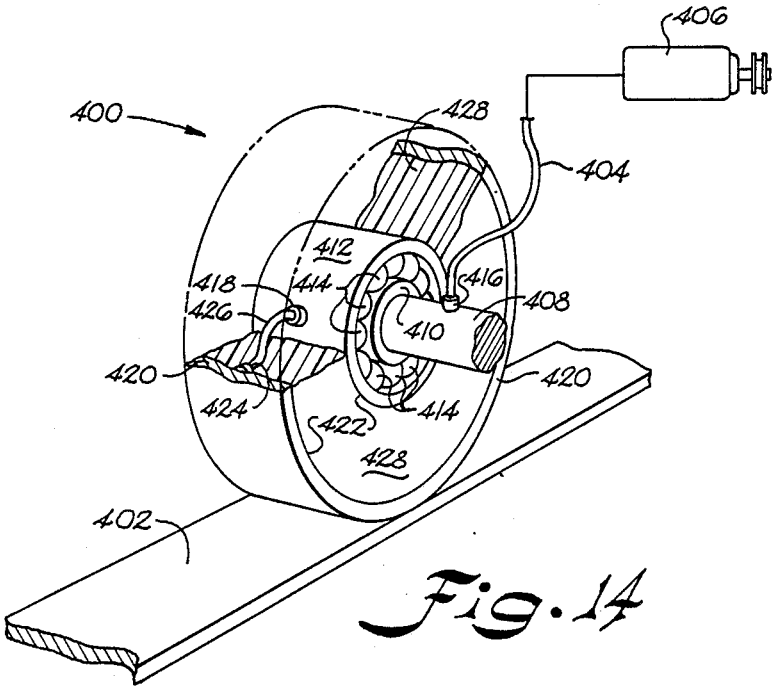
FIG. 14 illustrates a partial see-through perspective view of an alternative embodiment of a rotatable electrical contact member in accordance with the present invention.

As discussed above, particularly in conjunction with FIGS. 2-5, alternate embodiments of rotatable electric contact members may be utilized in accordance with the present invention. FIG. 14 is an example of one such alternate to the stainless steel brushes represented in FIG. 4. The contact of FIG. 14 is "brushless", to be generally quieter and longer lasting. Certain aspects of the embodiment of FIG. 14 are in common with the constructions illustrated in FIGS. 4 and 5. In particular, the central axle, fixed terminal, and bearing features thereof are substantially the same, all of which are discussed hereinafter.

FIG. 14 illustrates such an exemplary alternative embodiment of an electric contact for conducting electricity between a track having an electrified member therealong and an electrically-powered vehicle adapted for traveling over such track. Contact 400 preferably rotates over an electrified rail 402, and conducts electricity via a wire 404 to a chassis-carried load such as an electric motor means 406 or the like. As understood from the foregoing discussion in conjunction with FIGS. 4 and 5, preferably at least a pair of such contacts 400 utilized with lateral spacing therebetween for correspondence and alignment with a pair of electrified rails (such as illustrated in FIG. 5). As also discussed in conjunction with FIG. 9, normally at least two electrical interconnections with a load such as a motor means are needed in order to effect an electrical circuit therewith. For the purposes of the alternative illustration of FIG. 14, only one alternative rotatable contact and its interconnection with an electrical load is illustrated.

Rotatable contact 400 includes a relatively fixed central axle 408 which is fixed relative the chassis and supported thereon, such as through a guide head assembly structure as illustrated and discussed in conjunction with FIG. 4. The central axle further includes a bearing having an electrically-conductive inner race 410, an electrically-conductive outer race 412, and a plurality of electrical-conductive roller bearings 414 trapped therebetween. As discussed above in conjunction with FIG. 5, the central axle may be carried directly or indirectly on the vehicle by an insulative mounting, with the inner race 410 fixed relative thereto, and with the outer race 412 rotatable relative thereto.

A fixed electric terminal 416 is associated with the relatively fixed inner race 410, and adapted to electrically interconnect through electric wire 404 to the electrically powered motive means supported by the vehicle on which the rotatable contact 400 is associated. A first rotatable electric terminal 418 is associated with the relatively rotated outer race 412.

An electrically-conductive annular member 420 is situated concentrically about central axle 408, and forms the outside diameter of the electric contact 400. Such positioning of annular member 420 in conjunction with the outer race 412 of the bearing defines an annular space 422 between the inside diameter of annular member 420 and the central axle outer race 412.

A second rotatable electric terminal 424 is associated with annular member 420, preferably on the inside diameter thereof, and is interconnected by electrically-conductive wire means 426 with the first rotatable electric terminal 418, with electricity being conducted therebetween. Resilient filler material 428 resides in and fills the annular space 422, so that annular member 420 and outer race 412 are generally coupled for mutual rotation relative central axle inner race 410. Therefore, annular member 420 is rotatable over a track electrified member 402 as a vehicle carrying electric contact 400 travels over such track. Electricity is conducted from electrified rail 402 to the vehicle through an electrically-conductive pathway formed by annular member 420, second rotatable terminal 424, wire means 426, first rotatable terminal 418, outer race 412, roller bearings 414, inner race 410, and fixed terminal 416. Electrical contact is thus provided to the vehicle wire 404, and consequently vehicle motor means 406, from track electrified rail 402, while the resilient filler material 428 provides insulation against mechanical shock and noise.

Furthermore, the first rotatable electric terminal 418 is preferably mounted on the outside diameter of the bearing outer race so as to reside within annular space 422, which is the same as the second rotatable electric terminal 424, which resides on the inside diameter of annular member 420. Wire means 426 thus resides within the annular space and is surrounded by the filler material 428 also within such space. Such resilient filler material may comprise injectable or moldable resilient substances, such as polyurethane foam or rubber and the like. The electrically-conductive annular member 420 may comprise a section or length of metal pipe or the like. The foregoing is only one exemplary of alternative embodiment of a rotatable electric contact which may be utilized in place of the stainless steel brushes of FIG. 4. Moreover, other forms of electrical contact members, such as non-rotating members, or fixed brush members, may be utilized.

The best mode of the present invention is generally directed to a portable amusement ride, as is specifically illustrated herein. Those of ordinary skill in the art will appreciate that various modifications and variations to this invention may be practiced. For example, a permanent installation amusement ride may utilize the track control features, and the vehicle features of this invention. Moreover, mobile vehicles may be provided in a variety of forms, and for a variety of purposes. One such alternative purpose might be a transportation system, such as an outside rail car or the like, or subway car, or delivery cars within a plant or building. Moreover, a particular head assembly in accordance with this invention may be utilized for one or the other, instead of both, electrical pick-up and guidance features.

Other alternatives may be practiced. For example, vertical guide shaft 128 or guide head assembly 136 may be interconnected to a wheel tie rod for turning the front wheels, rather than directly linked to the vehicle chassis.

As in many instances suggested throughout the above specification, variations on the presently disclosed features may be practiced utilizing the existing illustrated circuits or construction. For example, a given track may be electrified in either an AC or DC electrical power transmission mode. Primary track 14 may be electrified generally at a higher voltage level than secondary track 28, so that vehicles normally traveling on the main path operate at a relatively higher, and presumably more enjoyable, speed, while cars in the loading and unloading area operate at a lower, safer speed.

Furthermore, numerous layout options may be practiced. For example, preferred dimensions of the FIG. 1A layout is approximately fifty feet by sixty feet, with about 275 feet of track. Alternatively, multiple exit points, and even multiple secondary track portions may be provided. For example, on a much larger primary track, several relatively widely separated secondary track portions may be provided with an operator at each, and with corresponding, respective entry and exit points. In such instance, instead of utilizing timer means on the vehicle, vehicles approaching an area may be routed from the track. Selection of vehicles can be made on some other alternate basis, such as the color of the vehicle (for example red or blue) such that each given vehicle makes one complete circuit of the enlarged area track, though the multiple secondary track positions and operators therefore in fact enlarge the number of passengers which may be accommodated by the amusement ride.

Furthermore, in those instances where transportation systems are established, such multiple secondary tracks can in fact serve as separate loading and unloading stations between relatively long distance locations, with the vehicles themselves incorporating radio transmitters or the like of relatively short transmission distance capabilities, for actuating an exit command signal so as to cause their respective vehicle to exit the track into their desired station.

All such modifications and variations are intended to come within the spirit and scope of the present invention, which is further recited only by the following claims, all of the foregoing being intended as exemplary and illustrative only of various embodiments of this invention.

What is claimed is:

1. A controlled track arrangement for an amusement ride featuring a plurality of guidable, electrically-powered vehicles, said track arrangement comprising:

a primary track having a circuitous guide path which may be controllably electrified over the entire pathway thereof so as to continuously guide and advance in a predetermined direction thereabout guidable, electric-powered vehicles, said primary track including an entrance point at which vehicles off the circuitous guide path may be routed thereunto, and an exit point at which vehicles on the circuitous guide path may be routed therefrom;

a secondary track having a one-way guide path interconnecting between said primary exit point and said entrance point thereof, said secondary track path including a plurality of consecutive, separately electrifiable path segments to permit respective vehicles to be selectively and controllably advanced therealong for loading and unloading of passengers for such vehicles; and automatic launch control means, responsive to the travel of vehicles on said primary track path, for automatically preventing vehicles situated on said secondary track path and entering said primary track path at said entrance point thereof from colliding with vehicles already on said primary track path, therein said automatic launch control means includes sensor means adjacent said primary track path for sensing passage of a vehicle thereby, whereby said automatic launch control means is responsive to the travel of vehicles on said primary track path.

2. A controlled track arrangement as in claim 1, wherein said primary and secondary track guide paths each include a pair of parallel, separately electrifiable rails formed in their respective primary and secondary tracks, and exposed to the upper surface thereof for contact with electrical pick-ups of electric-powered vehicles traveling over such tracks, said rail pairs being adapted for the transmission of either AC or DC electric power.

3. A controlled track arrangement as in claim 2, wherein said paired parallel rails comprise respective pairs of U-shaped members turned with their respective openings mutually facing, and in spaced relationship, so as to define a guide channel therebetween, said guide channel having an upwardly facing slot for receipt therethrough of a guidable member from vehicles traveling over such tracks, whereby such guidable member may be received through such slot and be guided in said defined guide channel by deflections therefrom.

4. A controlled track arrangement as in claim 3, wherein said primary and secondary tracks variously comprise banked, curved, and elevated portions thereof, with their respective parallel rails always presenting exposed pick-up surfaces generally parallel to the surface of such tracks, and with said guide channel and corresponding slot entrance thereto situated so as to receive the vehicle guidable member therethrough in a substantially perpendicular relationship to such track surface, whereby such vehicle guidable member may be properly guided in said guide channel while carrying thereon electric contact means correspondingly appropriately positioned relative said electrifiable rails for satisfactory electrical contact continuously therewith.

5. A controlled track arrangement as in claim 1, further comprising track path electrification control means, including main run control means for controllably electrifying the entire pathway of said primary track, emergency stop control means for controllably interrupting electrification of said primary track path and said secondary track path, including all portions thereof, and respectively controllable means for intermittently electrifying said secondary track path segments, so as to selectively advance vehicles along said secondary track path by successive electrification of consecutive path segments.

6. A controlled track arrangement as in claim 1, further including automatic exit control means, responsive to an exit command signal, for automatically routing from said primary track path to said secondary track path only the vehicle next approaching said exit point of said primary track path.

7. A controlled track arrangement as in claim 1, wherein:

said automatic launch control means further includes launch segment control means for selectively controlling electrification of a secondary track guide path launch segment, defined as adjacent to and interconnecting with said primary track path entrance point;

said sensor means is situated adjacent said primary track path a known distance upstream from said entrance point thereof, for detecting the passage of a vehicle thereby on said primary track path, and outputting a signal indicative of same; and said automatic launch control means further includes timer delay energization means, responsive to outputs from said sensor means, for controlling said launch segment control means so as to cause electrification of said secondary track path launch segment responsive to passage of a predetermined time delay after a vehicle moves past said sensor means, whereby selection of said predetermined time delay relative the known upstream distance of said sensor means from said primary track path entrance point in conjunction with known travel speed of vehicles on said primary track path ensures advancement beyond said primary track path entrance point of a vehicle sensed passing said sensory means before said secondary track path launch segment is electrified for causing a vehicle thereon to enter said entrance point.

8. A controlled track arrangement as in claim 7, further comprising:

entrance point gate means, for controllably permitting or denying entrance of vehicles onto said primary track path at said entrance thereof, from said secondary track path launch segment; and wherein said timer delay energization means is further responsive to said sensor means for temporarily controlling said entrance point gate means as to permit vehicles to enter said primary track path while said secondary track path launch segment is electrified, wherein said entrance point gate means is otherwise controlled for denying entrance of vehicles to said primary track path.

9. A controlled track arrangement as in claim 7, wherein said timer delay energization means includes launch control reset means for resetting counting of said time delay after every occurrence of de-electrification of said primary track path, to ensure energization of said secondary track path launch segment based on passage of the full predetermined time delay.

10. A controlled track arrangement for an amusement ride featuring a plurality of guidable, electric-powered vehicles, said track arrangement comprising:

a primary track having a circuitous guide path which may be controllably electrified over the entire pathway thereof so as to continuously guide and advance in a predetermined direction thereabout guidable, electric-powered vehicles, said primary track including an entrance point at which vehicles off the circuitous guide path may be routed thereunto, and an exit point at which vehicles on the circuitous guide path may be routed therefrom;

a secondary track having a one-way guide path interconnecting between said primary track exit point and said entrance point thereof, said secondary track path including a plurality of consecutive, separately electrifiable path segments to permit respective vehicles to be selectively and controllably advanced therealong for loading and unloading of passengers for such vehicles; and automatic exit control means, responsive to an exit command signal input thereto, for automatically routing from said primary track path to said secondary track path only the vehicle next approaching said exit point of said primary track path;

wherein said automatic exit control means includes exit point gate means, situated at said primary track path exit point, for controllably assuming a first position for permitting vehicles on said primary track path to continue thereabout, and a second position for diverting vehicles on said primary track path onto said secondary track path at said exit point, said exit point gate means normally occupying said first position thereof;

first exit sensor means, located adjacent said primary track path relatively upstream from said exit point thereof, and responsive to said exit command signal, for causing said exit point gate means to assume said second position thereof upon passage of a vehicle thereby; and second exit sensor means, located adjacent said secondary track path situated relatively downstream from said primary track path exit point, for causing upon passage of a vehicle thereby said exit point gate means to reassume said first position thereof.

11. A controlled track arrangement as in claim 10, wherein said primary and secondary track guide paths each include a pair of parallel, separately electrifiable rails formed in their respective primary and secondary tracks, and exposed to the upper surface thereof for contact with electrical pick-ups of electric-powered vehicles traveling over such tracks, said rail pairs being adapted for the transmission of either AC or DC electric power.

12. A controlled track arrangement as in claim 11, wherein said paired parallel rails comprise respective pairs of U-shaped members turned with their respective openings mutually facing, and in spaced relationship, so as to define a guide channel therebetween, said guide channel having an upwardly facing slot for receipt therethrough of a guidable member from vehicles traveling over such tracks, whereby such guidable member may be received through such slot and be guided in said defined guide channel by deflections therefrom.

13. A controlled track arrangement as in claim 10, further comprising track path electrification control means, including main run control means for controllably electrifying the entire pathway of said primary track, emergency stop control means for controllably interrupting electrification of said primary track path and said secondary track path, including all portions thereof, and respectively controllable means for intermittently electrifying said secondary track path segments, so as to selectively advance vehicles along said secondary track path by successive electrification of consecutive path segments.

14. A controlled track arrangement as in claim 10, further comprising automatic launch control means, responsive to the travel of vehicles on said primary track path, for automatically preventing vehicles situated on said secondary track path and entering said primary track path at said entrance point thereof from colliding with vehicles already on said primary track path.

15. A controlled track arrangement as in claim 10, wherein said second exit sensor means further operates for resetting said first sensor exit means to prevent its actuation by passage of a vehicle thereby until said first sensor exit means is reactuated by reiteration of said exit command signal, whereby said automatic exit control means functions to automatically remove from said primary track path to said secondary track path only the next vehicle approaching said exit point on said primary track path, responsive to a single iteration of said exit command signal.

16. A controlled track arrangement for an amusement ride featuring a plurality of guidable electric-powered vehicles, said track arrangement comprising:

a primary track having a circuitous guide path which may be controllably electrified over the entire pathway thereof so as to continuously guide and advance in a predetermined direction thereabout guidable, electric-powered vehicles, said primary track including an entrance point at which vehicles off the circuitous guide path may be routed thereunto, and an exit point at which vehicles on the vehicles on the circuitous guide path may be routed therefrom;

a secondary track having a one-way guide path interconnecting between said primary track exit point and said entrance point thereof, said secondary track path including a plurality of consecutive, separately electrifiable path segments to permit respective vehicles to be selectively and controllably advanced therealong for loading and unloading of passengers for such vehicles; wherein said primary and secondary track guide paths each include a pair of parallel, separately electrifiable rails formed in their respective primary and secondary tracks, and exposed to the upper surface thereof for contact with electrical pick-ups of electric-powered vehicles traveling over such tracks, said rail pairs being adapted for the transmission of either AC or DC electric power;

said paired parallel rails comprise respective pairs of U-shaped members turned with their respective openings mutually facing, and in spaced relationship, so as to define a guide channel therebetween, said guide channel having an upwardly facing slot for receipt therethrough of a guidable member from vehicles traveling over such tracks, whereby such guidable member may be received through such slot and be guided in said defined guide channel by deflections therefrom; and further wherein said primary and secondary tracks variously comprise banked, curved, and elevated portions thereof, with their respective parallel rails always presenting exposed pick-up surfaces generally parallel to the surface of such tracks, and with said guide channel and corresponding slot entrance thereto situated so as to receive the vehicle guidable member therethrough in a substantially perpendicular relationship to such track surface, whereby such vehicle guidable member may be properly guided in said guide channel while carrying thereon electric contact means correspondingly appropriately positioned relative said electrifiable rails for satisfactory electrical contact continuously therewith.

17. A controlled track arrangement for an amusement ride featuring a plurality of guidable, electrically-powered vehicles, said track arrangement comprising:

primary track having a circuitous guide path which may be controllably electrified over the entire pathway thereof so as to continuously guide and advance in a predetermined direction thereabout guidable, electric-powered vehicles, said primary track including an entrance point at which vehicles off the circuitous guide path may be routed thereunto, and an exit point at which vehicles on the circuitous guide path may be routed therefrom;

a secondary track having a one-way guide path interconnecting between said primary track exit point and said entrance point thereof, said secondary track path including a plurality of consecutive, separately electrifiable path segments to permit respective vehicles to be selectively and controllably advanced therealong for loading and unloading of passengers for such vehicles; and said track arrangement further comprising an electric contact for conducting electricity between said primary and secondary tracks having said electrified paths therealong and an electrically-powered vehicle adapted for traveling over said tracks, said contact comprising:

a central axle including a bearing having electrically-conductive inner and outer race with electrically-conductive roller bearings trapped therebetween, said bearing being adapted to be carried on the vehicle by an insulative mounting with said inner race fixed relative thereto and said outer race rotatable relative thereto;

a fixed electric terminal associated with the relatively fixed inner race, and adapted to electrically interconnect with an electrically-powered motive means supported in the vehicle on which said bearing is carried;

a first rotatable electric terminal associated with said relatively rotatable outer race;

an electrically-conductive annular member, situated concentrically about said central axle, forming the outside diameter of said electric contact, and defining an annular space between the inside diameter thereof and said central axle outer race;

a second rotatable electric terminal associated with said annular member;

electrically-conductive wire means inter-connected between said first and second rotatable electric terminals for conducting electrically therebetween; and resilient filler material residing in and filling said annular space between said annular member inside diameter and said central axle outer race so that said annular member and said outer race are generally coupled for mutual rotation relative said central axle inner race;

wherein said annular member is rotatable over said track electrified paths as a vehicle carrying said electric contact travels over such paths, with electricity being conducted from said tracks to such vehicle through an electrically-conductive pathway formed by said annular member, said second rotatable terminal, said wire means, said first rotatable terminal, said outer race, said roller bearings, said inner race, and said fixed terminal, whereby electrical contact is provided between such vehicle and such track while said resilient filler material provides insulation against mechanical shock and noise.

18. A track arrangement as in claim 17, wherein:

said first rotatable electric terminal is mounted on the outside diameter of said bearing outer race;

said second rotatable electric terminal is mounted on the inside diameter of said annular member; and said wire means resides within said annular space, and is surrounded by said filler material also in said annular space.

19. A track arrangement as in claim 17, wherein:

said electrically-conductive annular member generally comprises a length of metal pipe; and said resilient filler material comprises injectable or moldable resilient substances, such as polyurethane foam or rubber, which may be provided in said annular space.

20. A track arrangement as in claim 17 wherein said primary and secondary track guide paths each include a pair of parallel, separately electrifiable rails formed in their respective primary and secondary tracks, and said track arrangement further includes at least a pair of such electrical contacts adapted to be carried on a vehicle with lateral spacing therebetween for corresponding and electrical contact with said pair of separate electrified rails of each track, for enabling a vehicle electrically-powered motive means to complete an electrical circuit with such pair of electrified track rails.

* * * * *